US011094260B2

(12) United States Patent
Yang et al.

(10) Patent No.: US 11,094,260 B2
(45) Date of Patent: Aug. 17, 2021

(54) PIXEL CIRCUIT, DISPLAY PANEL, DISPLAY DEVICE, AND DRIVING METHOD

(71) Applicant: BOE TECHNOLOGY GROUP CO., LTD., Beijing (CN)

(72) Inventors: Shengji Yang, Beijing (CN); Xue Dong, Beijing (CN); Xiaochuan Chen, Beijing (CN); Hui Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 61 days.

(21) Appl. No.: 16/608,368

(22) PCT Filed: Apr. 12, 2019

(86) PCT No.: PCT/CN2019/082465
§ 371 (c)(1),
(2) Date: Oct. 25, 2019

(87) PCT Pub. No.: WO2019/201171
PCT Pub. Date: Oct. 24, 2019

(65) Prior Publication Data

US 2021/0110770 A1 Apr. 15, 2021

(30) Foreign Application Priority Data

Apr. 19, 2018 (CN) ..... 201810353782.5

(51) Int. Cl.
*G09G 3/3258* (2016.01)
*G09G 3/3275* (2016.01)

(52) U.S. Cl.
CPC ... *G09G 3/3258* (2013.01); *G09G 2300/0842* (2013.01); *G09G 2320/0626* (2013.01); *G09G 2360/144* (2013.01)

(58) Field of Classification Search
CPC ..... G09G 3/3225–3258; G09G 2300/0439; G09G 2300/0809; G09G 2300/0819;
(Continued)

(56) References Cited

U.S. PATENT DOCUMENTS

2006/0113918 A1* 6/2006 Lo ..... G09G 3/3233 315/169.2
2008/0309595 A1* 12/2008 Nitomi ..... G09G 3/3291 345/76
(Continued)

FOREIGN PATENT DOCUMENTS

CN 107123396 A 9/2017
CN 107393477 A 11/2017
(Continued)

OTHER PUBLICATIONS

International Search Report of PCT/CN2019/082465 in Chinese, dated Jul. 16, 2019, with English translation.

*Primary Examiner* — David Tung
(74) *Attorney, Agent, or Firm* — Collard & Roe, P.C.

(57) ABSTRACT

A pixel circuit, a display panel, a display device, and a method of driving a display device are provided. The pixel circuit includes a driving sub-circuit, a first data writing sub-circuit, a second data writing sub-circuit, and a storage sub-circuit. The first data writing sub-circuit is configured to write a first data voltage to a first terminal of the storage sub-circuit in a case of being turned on under control of a first data scanning signal; the second data writing sub-circuit is configured to write a second data voltage to a second terminal of the storage sub-circuit in a case of being turned on under control of a second data scanning signal; and the driving sub-circuit is configured to drive a light emitting element to emit light under control of the voltage at the first terminal of the storage sub-circuit.

19 Claims, 6 Drawing Sheets

(58) Field of Classification Search
CPC ... G09G 2300/0842; G09G 2300/0861; G09G 2320/043–048; G09G 2320/0626–0653; G09G 2360/144
See application file for complete search history.

(56) References Cited

U.S. PATENT DOCUMENTS

| | | | | |
|---|---|---|---|---|
| 2009/0115707 | A1* | 5/2009 | Park | G09G 3/3291 345/76 |
| 2011/0045929 | A1* | 2/2011 | Rolando | F16H 7/1218 474/112 |
| 2011/0074758 | A1* | 3/2011 | Wacyk | G09G 3/3258 345/211 |
| 2012/0169798 | A1* | 7/2012 | Ebisuno | G09G 3/325 345/690 |
| 2012/0249516 | A1* | 10/2012 | Wacyk | G09G 3/3233 345/212 |
| 2013/0069924 | A1* | 3/2013 | Robinson | G09G 3/20 345/207 |
| 2015/0213756 | A1* | 7/2015 | Wacyk | G09G 3/006 345/690 |
| 2015/0366026 | A1* | 12/2015 | Nebon | G09G 3/3233 315/291 |
| 2017/0206839 | A1* | 7/2017 | Wu | G09G 3/3233 |
| 2019/0066585 | A1 | 2/2019 | Han | |
| 2019/0251905 | A1 | 8/2019 | Yang et al. | |

FOREIGN PATENT DOCUMENTS

| | | | |
|---|---|---|---|
| CN | 107424570 | A | 12/2017 |
| CN | 108510946 | A | 9/2018 |
| KR | 10-2009-0043294 | A | 5/2009 |

* cited by examiner

PIXEL CIRCUIT, DISPLAY PANEL, DISPLAY DEVICE, AND DRIVING METHOD

CROSS REFERENCE TO RELATED APPLICATIONS

This application is the National Stage of PCT/CN2019/082465 filed on Apr. 12, 2019, which claims priority under 35 U.S.C. § 119 of Chinese Application No. 201810353782.5 filed on Apr. 19, 2018, the disclosure of which is incorporated by reference.

TECHNICAL FIELD

Embodiments of the present disclosure relate to a pixel circuit, a display panel, a display device, and a method of driving a display device.

BACKGROUND

Organic light emitting diode display panels have been widely used. Because the organic light emitting diode display panels can actively emit light, there is no need to additionally set a backlight, thereby meeting the demand of users for display devices of light weight and thin thickness.

With the enhancement of requirements of the users, techniques have been developed to change the contrast ratio of display devices according to the change of ambient brightness. For example, high contrast ratio and low brightness are required for nighttime display, and low contrast ratio and high brightness are required for daytime display.

SUMMARY

At least some embodiments of the present disclosure provide a pixel circuit, a display panel, a display device, and a method of driving a display device. The pixel circuit can realize two operation modes, i.e., high brightness and high contrast ratio, and a structure thereof is simple and is easy to be implemented.

At least some embodiments of the present disclosure provide a pixel circuit, which includes: a driving sub-circuit, a first data writing sub-circuit, a second data writing sub-circuit, and a storage sub-circuit. The first data writing sub-circuit is electrically connected to a first terminal of the storage sub-circuit, and is configured to write a first data voltage to the first terminal of the storage sub-circuit in a case of being turned on under control of a first data scanning signal; the second data writing sub-circuit is electrically connected to a second terminal of the storage sub-circuit, and is configured to write a second data voltage to the second terminal of the storage sub-circuit in a case of being turned on under control of a second data scanning signal, so as to control a voltage at the first terminal of the storage sub-circuit based on the second data voltage; the first terminal of the storage sub-circuit is further electrically connected to a control terminal of the driving sub-circuit; and the driving sub-circuit is configured to drive a light emitting element to emit light under control of the voltage at the first terminal of the storage sub-circuit.

For example, in the pixel circuit provided by some embodiments of the present disclosure, the second data writing sub-circuit includes a first data writing transistor, a gate electrode of the first data writing transistor is configured to receive the second data scanning signal, a first electrode of the first data writing transistor is configured to receive the second data voltage, and a second electrode of the first data writing transistor is electrically connected to the second terminal of the storage sub-circuit.

For example, in the pixel circuit provided by some embodiments of the present disclosure, the first data writing transistor is turned on in a case where the second data scanning signal is at a first level, the first data writing transistor is turned off in a case where the second data scanning signal is at a second level, and the first level is opposite to the second level.

For example, in the pixel circuit provided by some embodiments of the present disclosure, the first data writing transistor is a P-type transistor.

For example, in the pixel circuit provided by some embodiments of the present disclosure, a control terminal of the first data writing sub-circuit is configured to receive the first data scanning signal, the control terminal of the first data writing sub-circuit includes a first control sub-terminal and a second control sub-terminal, the first data scanning signal includes a first data scanning sub-signal and a second data scanning sub-signal, the first control sub-terminal is configured to receive the first data scanning sub-signal, and the second control sub-terminal is configured to receive the second data scanning sub-signal.

For example, in the pixel circuit provided by some embodiments of the present disclosure, the first data writing sub-circuit includes an N-type data writing transistor and a P-type data writing transistor, a first electrode of the N-type data writing transistor and a first electrode of the P-type data writing transistor are both configured to receive the first data voltage, a second electrode of the N-type data writing transistor and a second electrode of the P-type data writing transistor are both electrically connected to the first terminal of the storage sub-circuit, the first control sub-terminal includes a gate electrode of the N-type data writing transistor, and the second control sub-terminal includes a gate electrode of the P-type data writing transistor.

For example, the pixel circuit provided by some embodiments of the present disclosure further includes a reset sub-circuit, a first output terminal of the reset sub-circuit is electrically connected to the second terminal of the storage sub-circuit, a second output terminal of the reset sub-circuit is electrically connected to an anode of the light emitting element, and the reset sub-circuit is configured to reset the second terminal of the storage sub-circuit under control of a first reset control signal, and to reset the anode of the light emitting element under control of a second reset control signal.

For example, in the pixel circuit provided by some embodiments of the present disclosure, an input terminal of the reset sub-circuit is electrically connected to a first reference level signal terminal and a second reference level signal terminal, the reset sub-circuit is configured to write a first reference level signal of the first reference level signal terminal to the second terminal of the storage sub-circuit under control of the first reset control signal, so as to reset the second terminal of the storage sub-circuit, and the reset sub-circuit is further configured to write a second reference level signal of the second reference level signal terminal to the anode of the light emitting element under control of the second reset control signal, so as to reset the anode of the light emitting element.

For example, in the pixel circuit provided by some embodiments of the present disclosure, the reset sub-circuit includes a first reset transistor and a second reset transistor, the input terminal of the reset sub-circuit includes a first electrode of the first reset transistor and a first electrode of the second reset transistor, the first output terminal includes a second electrode of the first reset transistor, the second output terminal includes a second electrode of the second reset transistor, a gate electrode of the first reset transistor is configured to receive the first reset control signal, the first electrode of the first reset transistor is electrically connected to the first reference level signal terminal, the second electrode of the first reset transistor is electrically connected to the second terminal of the storage sub-circuit, a gate electrode of the second reset transistor is configured to receive the second reset control signal, the first electrode of the second reset transistor is electrically connected to the second reference level signal terminal, and the second electrode of the second reset transistor is electrically connected to the anode of the light emitting element.

For example, the pixel circuit provided by some embodiments of the present disclosure further includes a light emitting control sub-circuit, and the light emitting control sub-circuit is configured to electrically connect or disconnect the driving sub-circuit and the light emitting element under control of a light emitting control signal.

For example, in the pixel circuit provided by some embodiments of the present disclosure, the light emitting control sub-circuit includes a light emitting control transistor, a gate electrode of the light emitting control transistor is configured to receive the light emitting control signal, a first electrode of the light emitting control transistor is electrically connected to a first level signal terminal, and a second electrode of the light emitting control transistor is electrically connected to the driving sub-circuit.

For example, in the pixel circuit provided by some embodiments of the present disclosure, the driving sub-circuit includes a driving transistor, a first electrode of the driving transistor is electrically connected to the light emitting control sub-circuit, a second electrode of the driving transistor is electrically connected to an anode of the light emitting element, and the control terminal of the driving sub-circuit includes a gate electrode of the driving transistor, the gate electrode of the driving transistor is electrically connected to the first terminal of the storage sub-circuit, and a cathode of the light emitting element is electrically connected to a second level signal terminal.

For example, in the pixel circuit provided by some embodiments of the present disclosure, the storage sub-circuit includes a storage capacitor, the first terminal of the storage sub-circuit includes a first terminal of the storage capacitor, and the second terminal of the storage sub-circuit includes a second terminal of the storage capacitor.

At least some embodiments of the present disclosure further provide a display panel, which includes the pixel circuit according to any one of the above-mentioned embodiments.

For example, the display panel provided by some embodiments of the present disclosure further includes a plurality of pixel units, the plurality of pixel units are arranged in a plurality of rows and a plurality of columns, and the pixel circuit is disposed in each of the plurality of pixel units.

For example, in the display panel provided by some embodiments of the present disclosure, the plurality of rows of pixel units in the plurality of pixel units are in one-to-one correspondence with a plurality of gate line groups, respectively, and the plurality of columns of pixel units in the plurality of pixel units are in one-to-one correspondence with a plurality of data line groups, respectively; each of the plurality of gate line groups includes a first gate line and a second gate line, the first gate line is configured to provide the first data scanning signal, and the second gate line is configured to provide the second data scanning signal; in pixel units of a same row, the first data writing sub-circuit in each of the pixel units is electrically connected to the first gate line to receive the first data scanning signal, and the second data writing sub-circuit in each of the pixel units is electrically connected to the second gate line to receive the second data scanning signal; each of the plurality of data line groups includes a first data line and a second data line, the first data line is configured to provide the first data voltage, and the second data line is configured to provide the second data voltage; and in pixel units of a same column, the first data writing sub-circuit in each of the pixel units is electrically connected to the first data line to receive the first data voltage, and the second data writing sub-circuit in each of the pixel units is electrically connected to the second data line to receive the second data voltage.

For example, in the display panel provided by some embodiments of the present disclosure, in a case where a control terminal of the first data writing sub-circuit includes a first control sub-terminal and a second control sub-terminal, the first gate line includes a first gate sub-line and a second gate sub-line, and in the pixel units of the same row, the first control sub-terminal of the first data writing sub-circuit in each of the pixel units is electrically connected to the first gate sub-line, and the second control sub-terminal of the first data writing sub-circuit in each of the pixel units is electrically connected to the second gate sub-line.

At least some embodiments of the present disclosure further provide a display device, which includes the display panel according to any one of the above-mentioned embodiments.

For example, the display device provided by some embodiments of the present disclosure further includes a photosensitive element, the photosensitive element is configured to detect brightness of an environment in which the display device is located, generate a first trigger signal to control the display device to be in a first operation mode in a case where the brightness is higher than or equal to a preset brightness, and generate a second trigger signal to control the display device to be in a second operation mode in a case where the brightness is lower than the preset brightness.

For example, in the display device provided by some embodiments of the present disclosure, display brightness of the display device in the first operation mode is higher than display brightness of the display device in the second operation mode.

For example, the display device provided by some embodiments of the present disclosure further includes a data driver, the data driver is electrically connected to the pixel circuit in the display panel via a first data line and a second data line, provide the first data voltage to the pixel circuit via the first data line, and provide the second data voltage to the pixel circuit via the second data line.

For example, the display device provided by some embodiments of the present disclosure further includes a gate driver, and the gate driver is configured to provide the first data scanning signal and the second data scanning signal to the pixel circuit in the display panel.

At least some embodiments of the present disclosure further provide a method of driving the display device according to any one of the above-mentioned embodiments, in a case where the photosensitive element generates the first trigger signal, an operation period of the display panel includes a charging phase, a voltage jump phase, and a light emitting phase, and the method includes: in the charging phase, controlling the first data writing sub-circuit to write the first data voltage to the first terminal of the storage sub-circuit; in the voltage jump phase, controlling the second data writing sub-circuit to write the second data voltage to the second terminal of the storage sub-circuit, so as to control the voltage at the first terminal of the storage sub-circuit, in which the voltage at the first terminal of the storage sub-circuit during the charging phase is different from the voltage at the first terminal of the storage sub-circuit during the voltage jump phase; and in the light emitting phase, the driving sub-circuit driving the light emitting element to emit light based on the voltage at the first terminal of the storage sub-circuit.

At least some embodiments of the present disclosure further provide a method of driving the display device according to any one of the above-mentioned embodiments, in a case where the photosensitive element generates the second trigger signal, an operation period of the display panel includes a charging phase and a light emitting phase, and the method includes: in the charging phase, controlling the first data writing sub-circuit to write the first data voltage to the first terminal of the storage sub-circuit; and in the light emitting phase, the driving sub-circuit driving the light emitting element to emit light based on the voltage at the first terminal of the storage sub-circuit.

BRIEF DESCRIPTION OF THE DRAWINGS

In order to clearly illustrate the technical solutions of the embodiments of the disclosure, the drawings of the embodiments will be briefly described in the following: it is obvious that the described drawings are only related to some embodiments of the disclosure and thus are not limitative to the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect". "connected", etc., are not intended to define a physical connection or mechanical connection, but may include an electrical connection, directly or indirectly. "On." "under," "right," "left" and the like are only used to indicate relative position relationship, and when the position of the object which is described is changed, the relative position relationship may be changed accordingly.

Specific embodiments of the present disclosure are described in detail below with reference to the accompanying drawings. It should be understood that the specific embodiments described herein are intended to describe and illustrate the present disclosure only and thus are not limitative to the present disclosure.

Figure 1A:
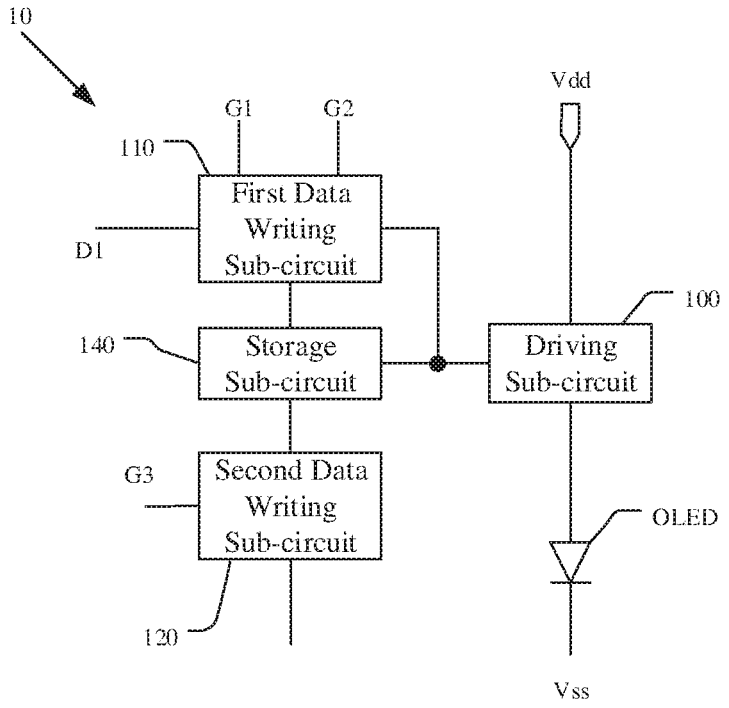
FIG. 1A is a schematic diagram of a pixel circuit provided by some embodiments of the present disclosure.
Figure 1B:
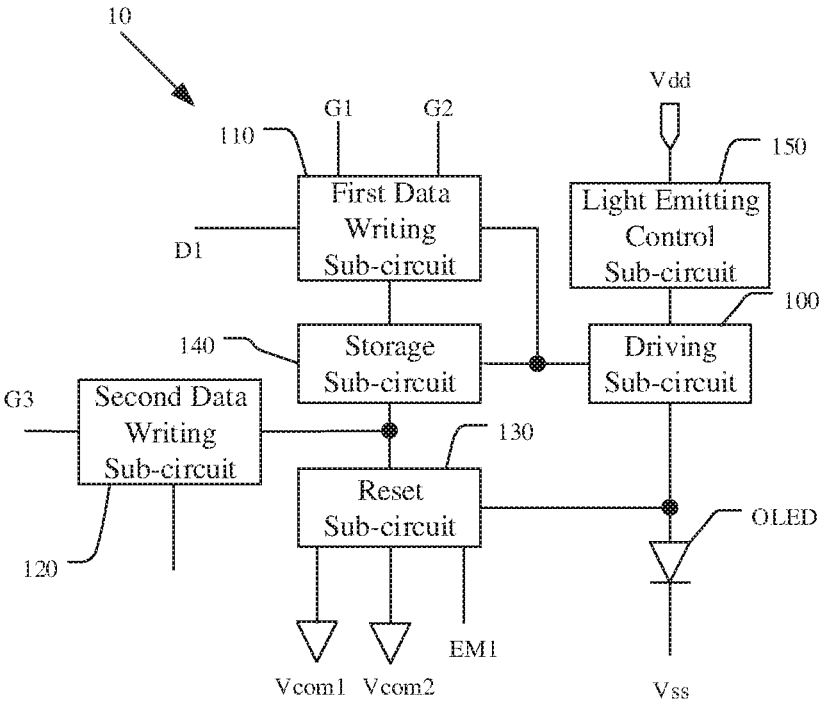
FIG. 1B is a schematic diagram of another pixel circuit provided by some embodiments of the present disclosure.
Figure 2A:
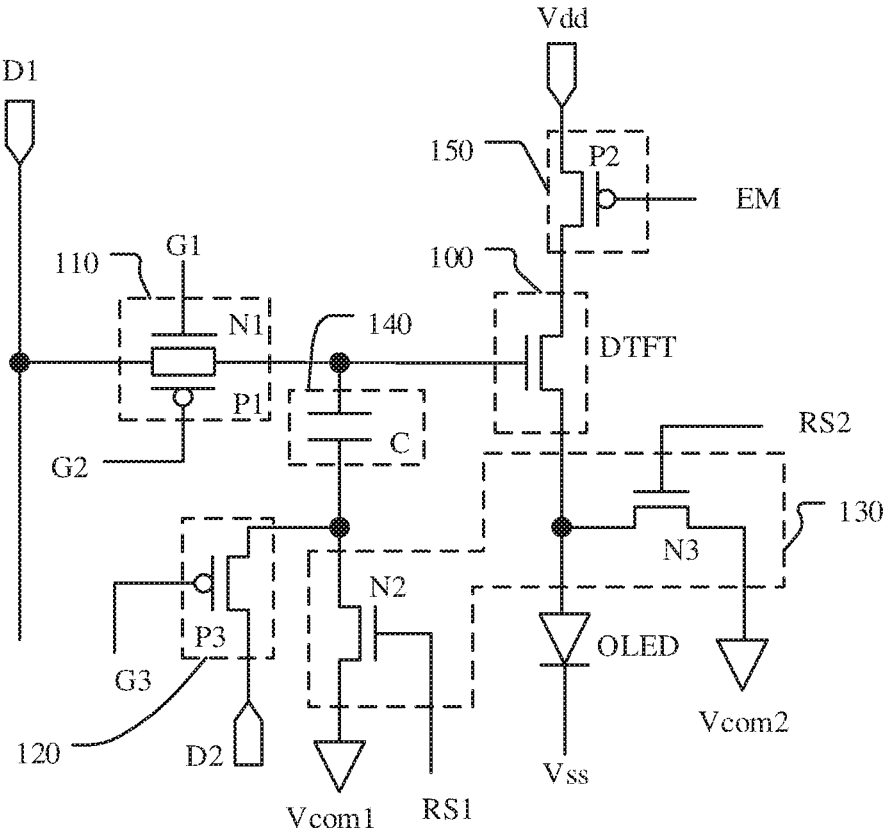
FIG. 2A is a schematic diagram of a circuit structure of a pixel circuit provided by some embodiments of the present disclosure.
Figure 2B:
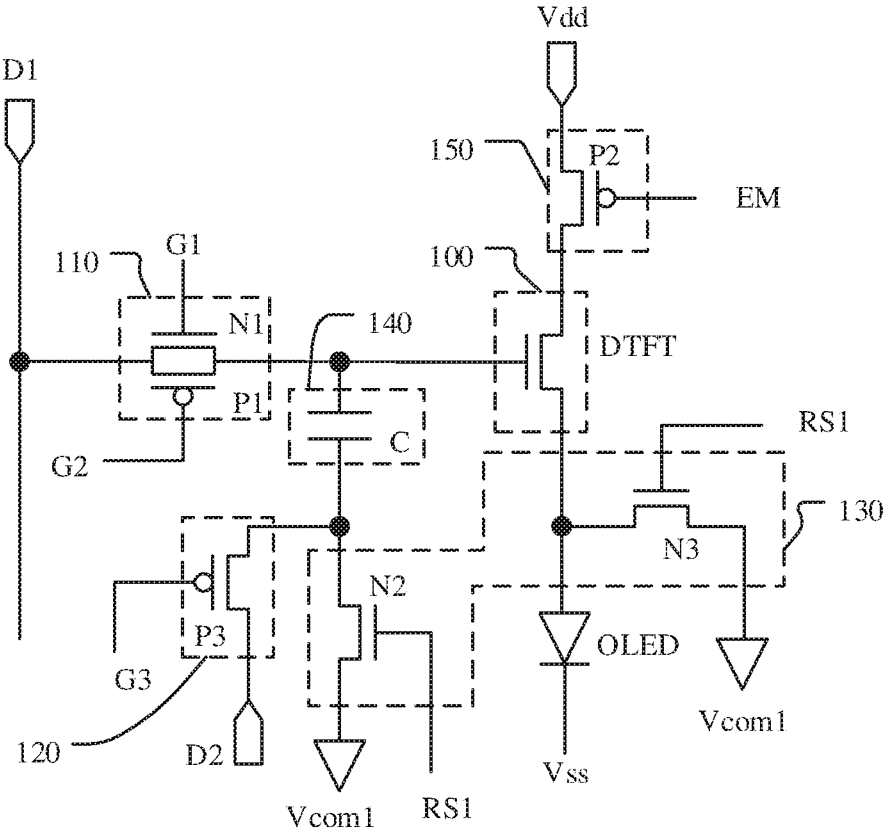
FIG. 2B is a schematic diagram of a circuit structure of another pixel circuit provided by some embodiments of the present disclosure.
Figure 3A:
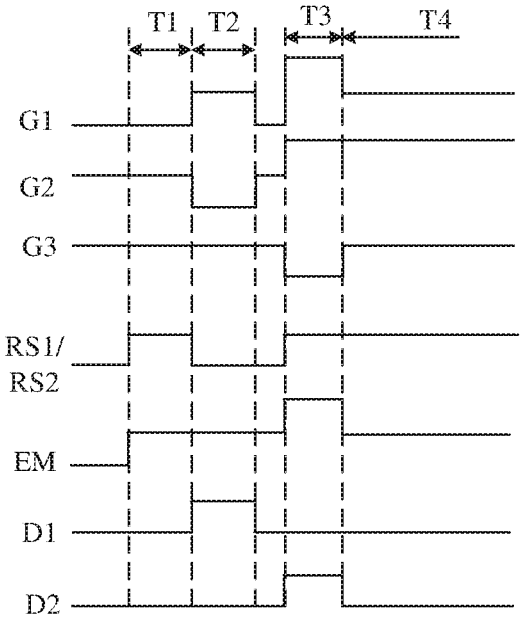
FIG. 3A is a signal timing diagram of a pixel circuit during operation provided by some embodiments of the present disclosure.
Figure 3B:
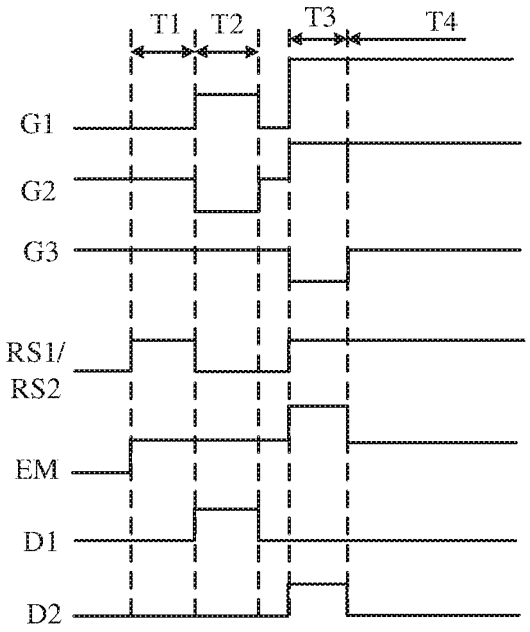
FIG. 3B is another signal timing diagram of a pixel circuit during operation provided by some embodiments of the present disclosure.
Figure 3C:
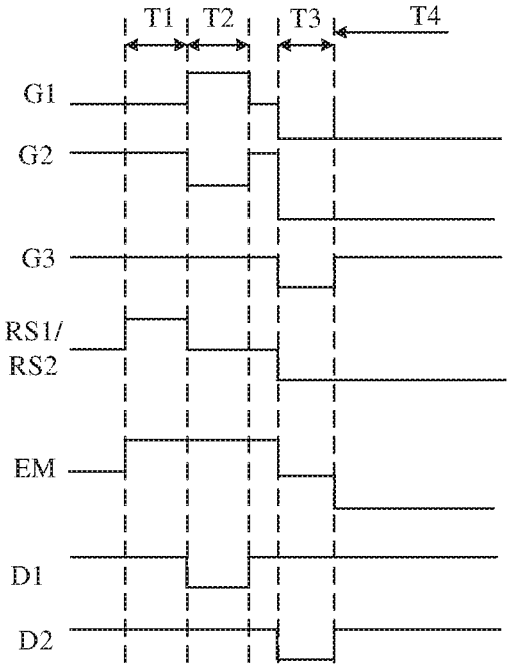
FIG. 3C is further another signal timing diagram of a pixel circuit during operation provided by some embodiments of the present disclosure.
Figure 4A:
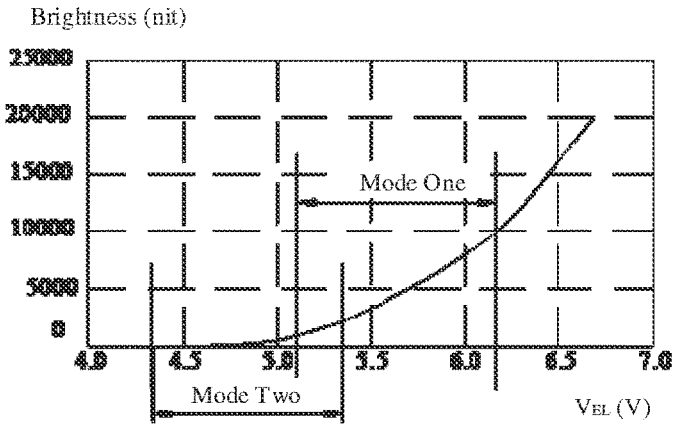
FIG. 4A is a diagram showing relationship of brightness and a voltage between two terminals of a light emitting element provided by some embodiments of the present disclosure.
Figure 4B:
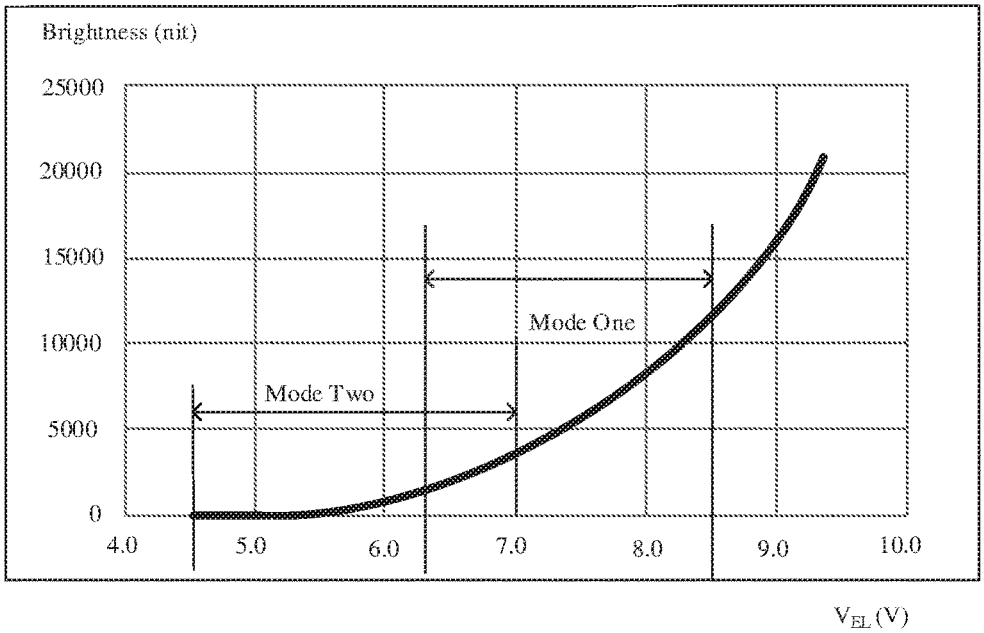
FIG. 4B is a diagram showing relationship of brightness and a voltage between two terminals of another light emitting element provided by some embodiments of the present disclosure.

At least some embodiments of the present disclosure provide a pixel circuit. FIG. 1A is a schematic diagram of a pixel circuit provided by some embodiments of the present disclosure; FIG. 1B is a schematic diagram of another pixel circuit provided by some embodiments of the present disclosure; FIG. 2A is a schematic diagram of a circuit structure of a pixel circuit provided by some embodiments of the present disclosure; FIG. 2B is a schematic diagram of a circuit structure of another pixel circuit provided by some embodiments of the present disclosure; FIG. 3A is a signal timing diagram of a pixel circuit during operation provided by some embodiments of the present disclosure; FIG. 3B is another signal timing diagram of a pixel circuit during operation provided by some embodiments of the present disclosure; FIG. 3C is further another signal timing diagram of a pixel circuit during operation provided by some embodiments of the present disclosure; FIG. 4A is a diagram showing relationship of brightness and a voltage between two terminals of a light emitting element provided by some embodiments of the present disclosure; and FIG. 4B is a diagram showing relationship of brightness and a voltage between two terminals of another light emitting element provided by some embodiments of the present disclosure.

For example, as illustrated in FIG. 1A, in some embodiments, a pixel circuit 10 includes a driving sub-circuit 100, a first data writing sub-circuit 110, a second data writing sub-circuit 120, and a storage sub-circuit 140. The pixel circuit 10 is configured to drive a light emitting element OLED to emit light.

For example, the first data writing sub-circuit 110 is electrically connected to a first terminal of the storage sub-circuit 140. Under control of a first data scanning signal, in a case where the first data writing sub-circuit 110 is turned on, the first data writing sub-circuit 110 is configured to write a first data voltage to the first terminal of the storage sub-circuit 140.

The second data writing sub-circuit 120 is electrically connected to a second terminal of the storage sub-circuit 140. That is, the first data writing sub-circuit 110 and the second data writing sub-circuit 120 are respectively connected to two terminals of the storage sub-circuit 140. Under control of a second data scanning signal, in a case where the second data writing sub-circuit 120 is turned on, the second data writing sub-circuit 120 is configured to write a second data voltage to the second terminal of the storage sub-circuit 140, so as to control a voltage at the first terminal of the storage sub-circuit 140 based on the second data voltage.

The first terminal of the storage sub-circuit 140 is further electrically connected to a control terminal of the driving sub-circuit 100; and the driving sub-circuit 100 is configured to drive the light emitting element OLED to emit light under control of the voltage at the first terminal of the storage sub-circuit 140.

The pixel circuit provided by the embodiments of the present disclosure can realize two operation modes, i.e., an operation mode of high brightness and an operation mode of low brightness, while ensuring high contrast ratio, and a structure thereof is simple and is easy to be implemented. For example, the embodiments of the present disclosure provide a Micro OLED driving scheme design for achieving high-voltage driving by using a low-voltage wafer MOS process. By adding a second data writing sub-circuit in the pixel circuit, and by means of voltage jump, together with the cooperation of values of respective control signals, the two operation modes can be realized. Under the limitation of the established low-voltage MOS process (for example, 0.11 μm, 6V process), the Micro OLED device can having high brightness and be compatible with high contrast ratio as well, within a specific voltage-endurance range of the wafer, so that high-voltage driving of the light emitting element can be realized under low-voltage TFT process, thereby achieving high brightness and meanwhile ensuring high contrast ratio.

For example, in some other embodiments, the pixel circuit 10 further includes a reset sub-circuit 130 and a light emitting control sub-circuit 150. As illustrated in FIG. 1B, the pixel circuit 10 includes the driving sub-circuit 100, the first data writing sub-circuit 110, the second data writing sub-circuit 120, the reset sub-circuit 130, the storage sub-circuit 140, and the light emitting control sub-circuit 150.

For example, an output terminal of the first data writing sub-circuit 110 is electrically connected to the first terminal of the storage sub-circuit 140, and an input terminal of the first data writing sub-circuit 110 and the output terminal of the first data writing sub-circuit 110 can be conductive under control of the first data scanning signal received by a control terminal of the first data writing sub-circuit 110.

For example, an output terminal of the second data writing sub-circuit 120 is electrically connected to the second terminal of the storage sub-circuit 140, and an input terminal of the second data writing sub-circuit 120 and the output terminal of the second data writing sub-circuit 120 can be conductive under control of the second data scanning signal received by a control terminal of the second data writing sub-circuit 120.

For example, the reset sub-circuit 130 is configured to reset the second terminal of the storage sub-circuit 140 under control of a first reset control signal, and to reset an anode of the light emitting element OLED under control of a second reset control signal.

For example, an input terminal of the reset sub-circuit 130 is electrically connected to a first reference level signal terminal Vcom1 and a second reference level signal terminal Vcom2, and a first output terminal of the reset sub-circuit 130 is electrically connected to the second terminal of the storage sub-circuit 140, and a second output terminal of the reset sub-circuit 130 is electrically connected to the anode of the light emitting element OLED. The input terminal of the reset sub-circuit 130 and the first output terminal of the reset sub-circuit 130 can be conductive under control of the first reset control signal received by a control terminal of the reset sub-circuit 130, and the input terminal of the reset sub-circuit 130 and the second output terminal of the reset sub-circuit 130 can be conductive under control of the second reset control signal received by the control terminal of the reset sub-circuit 130. That is, the reset sub-circuit 130 is configured to write a first reference level signal of the first reference level signal terminal Vcom1 to the second terminal of the storage sub-circuit 140 under control of the first reset control signal, so as to reset the second terminal of the storage sub-circuit 140, and the reset sub-circuit 130 is further configured to write a second reference level signal of the second reference level signal terminal Vcom2 to the anode of the light emitting element OLED under control of the second reset control signal, so as to reset the anode of the light emitting element OLED.

For example, the first terminal of the storage sub-circuit 140 is electrically connected to the control terminal of the driving sub-circuit 100, and the storage sub-circuit 140 is configured to store the first data voltage written by the first data writing sub-circuit 110 and the second data voltage written by the second data writing sub-circuit 120.

For example, the light emitting control sub-circuit 150 is configured to electrically connect or disconnect the driving sub-circuit 100 and the light emitting element OLED under control of a light emitting control signal. The light emitting control signal includes a first light emitting control sub-signal and a second light emitting control sub-signal.

As illustrated in FIG. 1A and FIG. 1B, a cathode of the light emitting element OLED is electrically connected to a second level signal terminal Vss. The light emitting control sub-circuit 150 is configured to allow a path to be formed between a first level signal terminal Vdd, a first terminal of the driving sub-circuit 100, a second terminal of the driving sub-circuit 100, the light emitting element OLED, and the second level signal terminal Vss upon receiving the first light emitting control sub-signal, and the light emitting control sub-circuit 150 is further configured to disconnect the path between the first level signal terminal Vdd, the first terminal of the driving sub-circuit 100, the second terminal of the driving sub-circuit 100, the light emitting diode OLED, and the second level signal terminal Vss upon receiving the second light emitting control sub-signal.

For example, the light emitting element OLED can be a light emitting diode, etc. The light emitting diode can be an organic light emitting diode (OLED) or a quantum dot light emitting diode (QLED), etc. The light emitting element OLED is configured to receive a light emitting signal (e.g., may be a current signal) during operation, and to emit light of an intensity corresponding to the light emitting signal.

For example, one of the first level signal terminal Vdd and the second level signal terminal Vss is a high level signal terminal, and the other is a low level signal terminal. In the embodiments illustrated in FIG. 1A and FIG. 1B, the first level signal terminal Vdd is a voltage source for outputting a constant positive voltage; and the second level signal terminal Vss can be a voltage source for outputting a constant negative voltage, or can be grounded, or the like.

For example, during the operation process of the pixel circuit 10, the signal outputted by the second level signal terminal Vss remains unchanged.

The pixel circuit provided by the present disclosure includes, in total, two data writing sub-circuits, i.e., the first data writing sub-circuit 110 and the second data writing sub-circuit 120.

The pixel circuit 10 can be applied in a display panel, such as an AMOLED display panel or the like. The final display brightness and image contrast ratio of the display panel are related to a voltage difference $V_{EL}$ between the anode and the cathode of the light emitting element OLED. The light emitting element OLED has two operation modes. In a case where the voltage difference $V_{EL}$ between the anode and the cathode of the light emitting element OLED is within a first range. Mode One (i.e., a first operation mode) of high brightness can be realized, and in a case where the voltage difference $V_{EL}$ between the anode and the cathode of the light emitting element OLED is within a second range, Mode Two (i.e., a second operation mode) of high contrast ratio can be realized.

The operation mode of a specific light emitting element is illustrated in FIG. 4A, and the operation mode of another specific light emitting element is illustrated in FIG. 4B. In some examples, as illustrated in FIG. 4A, in a case where the voltage difference $V_{EL}$ between the anode and the cathode of the light emitting element is within 4.3V to 5.4V, Mode Two of high contrast ratio can be realized; and in a case where the voltage difference $V_{EL}$ between the anode and the cathode of the light emitting element is within 5.1V to 6.1V, Mode One of high brightness can be realized. That is, the first range is 4.3V to 5.4V, and the second range is 5.1V to 6.1V. The present disclosure is not limited thereto. For example, in some other examples, as illustrated in FIG. 4B, in a case where the voltage difference $V_{EL}$ between the anode and the cathode of the light emitting element is within 4.5V to 7.0V, Mode Two of high contrast ratio can be realized; and in a case where the voltage difference $V_{EL}$ between the anode and the cathode of the light emitting element is within 6.2V to 8.5V, Mode One of high brightness can be realized. That is, the first range is 4.5V to 7.0V, and the second range is 6.2V to 8.5V.

In a case where brightness of the environment in which the display panel including the pixel circuit is located is high, and the display panel is required to realize a display effect of high brightness and high contrast ratio, the second data scanning signal is provided to the control terminal of the second data writing sub-circuit 120, and the second data voltage is provided to the input terminal of the second data writing sub-circuit 120, so as to boost the voltage at the first terminal of the storage sub-circuit 140, and thus, the voltage difference between two terminals of the light emitting element OLED can be increased, thereby ensuring the display effect of high brightness and high contrast ratio.

In a case where brightness of the environment in which the display panel including the pixel circuit is located is low, and the display panel is required to realize a display effect of low brightness and high contrast ratio, inputting the second data voltage to the storage sub-circuit 140 via the second data writing sub-circuit 120 is stopped, or the first data voltage is provided to the storage sub-circuit 140 via the second data writing sub-circuit 120, so as to ensure a small voltage difference between two terminals of the light emitting element OLED, thereby realizing the display effect of low brightness and high contrast ratio.

It can be seen that when the two different operation modes are implemented by using the pixel circuit 10 provided by the present disclosure, it is not necessary to provide two low-level signal terminals, nor to provide a complicated voltage switching circuit, and the pixel circuit 10 is easy to be implemented.

It should be noted that the transistors used in the embodiments of the present disclosure can be thin film transistors or field effect transistors or other switching elements having the same characteristics, and the thin film transistors can include oxide semiconductor thin film transistors, amorphous silicon thin film transistors or poly-silicon thin film transistors, etc. The source electrode and the drain electrode of the transistor can be symmetrical in structure, so the source electrode and the drain electrode of the transistor can be physically indistinguishable. In the embodiments of the present disclosure, in order to distinguish the electrodes of the transistor, except for the gate electrode serving as a control electrode, one of the rest electrodes is directly described as a first electrode, while the other as a second electrode. Therefore, in the embodiments of the present disclosure, the first electrode and the second electrode of all or part of the transistors are interchangeable as needed. For example, in some embodiments, the driving transistor used in the pixel circuit 10 provided by the present disclosure is a silicon-based transistor. For the silicon-based transistor, the problem of threshold voltage shift is not likely to occur, and thus, it is not necessary to provide a threshold compensation sub-circuit in the pixel circuit 10 provided by the present disclosure, either. However, the present disclosure is not limited thereto, and the threshold compensation sub-circuit can also be provided in the pixel circuit 10 provided by the present disclosure.

For example, according to the characteristics of the transistors, the transistors can be divided into N-type transistors and P-type transistors. For the sake of clarity, the embodiments of the present disclosure take the case that the transistors P1-P3 and the driving transistor DTFT are P-type transistors (for example, P-type MOS transistors), and the transistors N1-N3 are N-type transistors, as an example, to illustrate the technical solutions of the present disclosure. However, the transistors of the embodiments of the present disclosure are not limited to the above case, and those skilled in the art can also set the types of the transistors in the present disclosure as needed.

In the present disclosure, the reset sub-circuit 130 is configured to reset the storage sub-circuit 140 and the anode of the light emitting element OLED, and the light emitting control sub-circuit 150 is configured to prevent the light emitting element OLED from emitting light before the light emitting phase.

FIG. 2A is a schematic diagram of a circuit structure of the pixel circuit illustrated in FIG. 1B, and the pixel circuit of the present disclosure is described in detail below with reference to FIG. 2A.

For example, as illustrated in FIG. 2A, the driving sub-circuit 100 includes a driving transistor DTFT. A first electrode of the driving transistor DTFT is electrically connected to the light emitting control sub-circuit 150, a second electrode of the driving transistor DTFT is electrically connected to the anode of the light emitting element OLED, the control terminal of the driving sub-circuit 100 includes a gate electrode of the driving transistor DTFT, and the gate electrode of the driving transistor DTFT is electrically connected to the first terminal of the storage sub-circuit 140.

For example, the cathode of the light emitting element OLED is electrically connected to the second level signal terminal Vss.

For example, the control terminal of the first data writing sub-circuit 110 is electrically connected to a first gate line, so as to receive the first data scanning signal. In some embodiments, the control terminal of the first data writing sub-circuit 110 includes a first control sub-terminal and a second control sub-terminal, the first data scanning signal includes a first data scanning sub-signal and a second data scanning sub-signal, the first control sub-terminal is configured to receive the first data scanning sub-signal, and the second control sub-terminal is configured to receive the second data scanning sub-signal.

For example, in some examples, the first control sub-terminal is an N-type control terminal and the second control sub-terminal is a P-type control terminal. The first data scanning sub-signal is an N-type data scanning signal, and the second data scanning sub-signal is a P-type data scanning signal.

For example, as illustrated in FIG. 2A, the first data writing sub-circuit 110 includes an N-type data writing transistor N1 and a P-type data writing transistor P1. The input terminal of the first data writing sub-circuit 110 includes a first electrode of the N-type data writing transistor N1 and a first electrode of the P-type data writing transistor P1, the output terminal of the first data writing sub-circuit 110 includes a second electrode of the N-type data writing transistor N1 and a second electrode of the P-type data writing transistor P1, and the control terminal of the first data writing sub-circuit 110 includes a gate electrode of the N-type data writing transistor N1 and a gate electrode of the P-type data writing transistor P1.

For example, the first electrode of the N-type data writing transistor N1 and the first electrode of the P-type data writing transistor P1 are both configured to receive the first data voltage. For example, the first electrode of the N-type data writing transistor N1 and the first electrode of the P-type data writing transistor P1 are both electrically connected to a first data signal line D1 to receive the first data voltage. The second electrode of the N-type data writing transistor N1 and the second electrode of the P-type data writing transistor P1 are both electrically connected to the first terminal of the storage sub-circuit 140. The first control sub-terminal includes the gate electrode of the N-type data writing transistor N1, and the second control sub-terminal includes the gate electrode of the P-type data writing transistor P1, that is, the gate electrode of the N-type data writing transistor N1 is configured to receive the first data scanning sub-signal, and the gate electrode of the P-type data writing transistor P1 is configured to receive the second data scanning sub-signal.

For example, the first gate line includes a first gate sub-line G1 and a second gate sub-line G2, the first gate sub-line G1 is configured to output the first data scanning sub-signal, and the second gate sub-line G2 is configured to output the second data scanning sub-signal. Therefore, as illustrated in FIG. 2A, the gate electrode of the N-type data writing transistor N1 is electrically connected to the first gate sub-line G1 to receive the first data scanning sub-signal, and the gate electrode of the P-type data writing transistor P1 is electrically connected to the second gate sub-line G2 to receive the second data scanning sub-signal.

For example, the first data writing sub-circuit 110 adopts two transistors of different types, so that the voltage range of the data voltage being written can be increased. The N-type data writing transistor N1 corresponds to the first data voltage of high level, and the P-type data writing transistor P1 corresponds to the first data voltage of low level.

For example, as illustrated in FIG. 2A, the second data writing sub-circuit 120 includes a first data writing transistor P3. The input terminal of the second data writing sub-circuit 120 includes a first electrode of the first data writing transistor P3, and the output terminal of the second data writing sub-circuit 120 includes a second electrode of the first data writing transistor P3, and the control terminal of the data writing sub-circuit 120 includes a gate electrode of the first data writing transistor P3.

For example, the first data writing transistor P3 can be, for example, a P-type transistor, but the present disclosure is not limited thereto, and the first data writing transistor P3 can also be an N-type transistor.

For example, the gate electrode of the first data writing transistor P3 is electrically connected to a second gate line G3 to receive the second data scanning signal, and the first electrode of the first data writing transistor P3 is electrically connected to a second data line D2 to receive the second data voltage, and the second electrode of the first data writing transistor P3 is electrically connected to the second terminal of the storage sub-circuit 140.

For example, in a case where the second data scanning signal is at a first level, the first data writing transistor P3 is turned on, and in a case where the second data scanning signal is at a second level, the first data writing transistor P3 is turned off, and the first level is opposite to the second level. For example, in a case where the first data writing transistor P3 is a P-type transistor, the first level is a low level and the second level is a high level; and in a case where the first data writing transistor P3 is an N-type transistor, the first level is a high level and the second level is a low level.

For example, as illustrated in FIG. 2A, the storage sub-circuit 140 includes a storage capacitor C. The first terminal of the storage sub-circuit 140 includes a first terminal of the storage capacitor C, and the second terminal of the storage sub-circuit 140 includes a second terminal of the storage capacitor C. That is, the first terminal of the storage capacitor C is electrically connected to the second electrode of the N-type data writing transistor N1 and the second electrode of the P-type data writing transistor P1, and the second terminal of the storage capacitor C is electrically connected to the second electrode of the first data writing transistor P3.

For example, in a case where the first data writing transistor P3 writes the second data voltage to the second terminal of the storage capacitor C, the voltage at the first terminal of the storage capacitor C changes correspondingly due to the bootstrap effect of the storage capacitor C, and a change amount can be the second data voltage, thereby pulling up or pulling down the voltage at the first terminal of the storage capacitor C. For example, in a case where the second data voltage is a positive voltage, the voltage at the first terminal of the storage capacitor C is pulled up; and in a case where the second data voltage is a negative voltage, the voltage at the first terminal of the storage capacitor C is pulled down. It should be noted that before the first data writing transistor P3 writes the second data voltage to the second terminal of the storage capacitor C, the voltage at the second terminal of the storage capacitor C can be 0V.

For example, as illustrated in FIG. 2A, the reset sub-circuit 130 includes a first reset transistor N2 and a second reset transistor N3. The input terminal of the reset sub-circuit 130 includes a first electrode of the first reset transistor N2 and a first electrode of the second reset transistor N3, the first output terminal of the reset sub-circuit 130 includes a second electrode of the first reset transistor N2, and the second output terminal of the reset sub-circuit 130 includes a second electrode of the second reset transistor N3.

For example, as illustrated in FIG. 2A, a gate electrode of the first reset transistor N2 is connected to a first reset control signal line RS1 to receive the first reset control signal, the first electrode of the first reset transistor N2 is electrically connected to the first reference level signal terminal Vcom1 to receive the first reference level signal, and the second electrode of the first reset transistor N2 is electrically connected to the second terminal of the storage sub-circuit 140, that is, the second electrode of the first reset transistor N2 is electrically connected to the second terminal of the storage capacitor C. In a case where the first reset transistor N2 is turned on under control of the first reset control signal, the first reference level signal of the first reference level signal terminal Vcom1 is transmitted to the second terminal of the storage capacitor C via the first reset transistor N2, so as to reset the second terminal of the storage capacitor C.

For example, as illustrated in FIG. 2A, a gate electrode of the second reset transistor N3 is connected to a second reset control signal line RS2 to receive the second reset control signal, the first electrode of the second reset transistor N3 is electrically connected to the second reference level signal terminal Vcom2 to receive the second reference level signal, and the second electrode of the second reset transistor N3 is electrically connected to the anode of the light emitting element OLED. In a case where the second reset transistor N3 is turned on under control of the second reset control signal, the second reference level signal of the second reference level signal terminal Vcom2 is transmitted to the anode of the light emitting element OLED via the second reset transistor N3, so as to reset the anode of the light emitting element OLED.

For example, in some embodiments, as illustrated in FIG. 2A, the first reset control signal and the second reset control signal can be different signals. Alternatively, in some other embodiments, as illustrated in FIG. 2B, the first reset control signal and the second reset control signal are identical, i.e., the two are a same signal, so that the first reset control signal line RS1 or the second reset control signal line RS2 may be omitted. That is, in a case where only the first reset control signal line RS1 is provided, the gate electrode of the first reset transistor N2 and the gate electrode of the second reset transistor N3 can both be electrically connected to the first reset control signal line RS1; and in a case where only the second control signal line RS2 is provided, the gate electrode of the first reset transistor N2 and the gate electrode of the second reset transistor N3 can both be electrically connected to the second reset control signal line RS2.

For example, as illustrated in FIG. 2A, the first reference level signal and the second reference level signal can be different, but the embodiments of the present disclosure are not limited thereto. As illustrated in FIG. 2B, in some other embodiments, the first reference level signal and the second reference level signal can be identical. In a case where the first reference level signal and the second reference level signal are identical, only the first reference level signal terminal Vcom1 or only the second reference level signal terminal Vcom2 may be provided. That is, in a case where only the first reference level signal terminal Vcom1 is provided, the first electrode of the first reset transistor N2 and the first electrode of the second reset transistor N3 can both be electrically connected to the first reference level signal terminal Vcom1; and in a case where only the second reference level signal terminal Vcom2 is provided, the first electrode of the first reset transistor N2 and the first electrode of the second reset transistor N3 can both be electrically connected to the second reference level signal terminal Vcom2.

For example, the first reference level signal and the second reference level signal can both be set to 0V.

For example, as illustrated in FIG. 2A, the light emitting control sub-circuit 150 includes a light emitting control transistor P2. A gate electrode of the light emitting control transistor P2 is configured to receive the light emitting control signal, a first electrode of the light emitting control transistor P2 is electrically connected to the first level signal terminal Vdd, and a second electrode of the light emitting control transistor P2 is electrically connected to the driving sub-circuit 100. For example, a gate electrode of the light emitting control transistor P2 is connected to a light emitting control signal line EM to receive the light emitting control signal, and the second electrode of the light emitting control transistor P2 is electrically connected to the first electrode of the driving transistor DTFT.

The operation principle of the pixel circuit of the present disclosure is described in detail below with reference to the signal timing diagrams provided in FIG. 3A, FIG. 3B, and FIG. 3C. In a case where the display panel including the pixel circuit operates in the first operation mode of high contrast ratio and high brightness, an operation period of the pixel circuit includes a reset phase T1, a charging phase T2, a voltage jump phase T3, and a light emitting phase T4.

It should be noted that, in the following description of the present disclosure, the case that the first reset control signal and the second reset control signal are a same signal, and the first reference level signal and the second reference level signal are both set to 0V, is taken as an example. In the examples illustrated in FIG. 3A and FIG. 3B, the driving transistor DTFT is an N-type transistor, while in the example illustrated in FIG. 3C, the driving transistor DTFT is a P-type transistor.

For example, as illustrated in FIG. 3A and FIG. 3B, in a case where the driving transistor DTFT is an N-type transistor, the operation principle of the pixel circuit is as follows.

In the reset phase T1, the first reset control signal is provided to the first control terminal of the reset sub-circuit 130 through the first reset control signal line RS1, so as to electrically connect the input terminal of the reset sub-circuit 130 and the first output terminal of the reset sub-circuit 130, and further, to write the first reference level signal provided by the first reference level signal terminal Vcom1 to the second terminal of the storage sub-circuit 140, thereby resetting the second terminal of the storage sub-circuit 140 to facilitate writing the second data voltage in a subsequent phase. Moreover, in this reset phase T1, the second reset control signal is provided to the second control terminal of the reset sub-circuit 130 through the second reset control signal line RS2, so as to electrically connect the input terminal of the reset sub-circuit 130 and the second output terminal of the reset sub-circuit 130, and thus, the second reference level signal provided by the second reference level signal terminal Vcom2 can be written into the anode of the light emitting element OLED to reset the anode of the light emitting element OLED.

In the charging phase T2, the first data scanning sub-signal and the second data scanning sub-signal are provided to the control terminal of the first data writing sub-circuit 110 through the first gate sub-line G1 and the second gate sub-line G2, and the first data voltage is provided to the input terminal of the first data writing sub-circuit 110 through the first data line D1, so as to electrically connect the input terminal of the first data writing sub-circuit 110 and the output terminal of the first data writing sub-circuit 110, thereby writing the first data voltage to the first terminal of the storage sub-circuit 140 and enabling the gate voltage of the driving transistor DTFT to reach a first voltage V1.

For example, in the example illustrated in FIG. 3A, in the charging phase T2, the first data scanning sub-signal provided by the first gate sub-line G1 is at a high level, and the second data scanning sub-signal provided by the second gate sub-line G2 is at a low level, so that both the N-type data writing transistor and the P-type data writing transistor in the first data writing sub-circuit 110 are turned on. However, the embodiments of the present disclosure are not limited thereto. In some examples, in the charging phase T2, one of the N-type data writing transistor and the P-type data writing transistor is turned on, and the other is turned off. For example, in a case where the first data voltage is a positive voltage, the N-type data writing transistor can be turned on, and the P-type data writing transistor can be turned off; and in a case where the first data voltage is a negative voltage, the N-type data writing transistor can be turned off, and the P-type data writing transistor can be turned on.

In the voltage jump phase T3, the second data scanning signal is provided to the control terminal of the second data writing sub-circuit 120 through the second gate line G3, so as to electrically connect the input terminal of the second data writing sub-circuit 120 and the output terminal of the second data writing sub-circuit 120, thereby storing the second data voltage written by the input terminal of the second data writing sub-circuit 120 into the second terminal of the storage sub-circuit 140. In the voltage jump phase T3, due to the bootstrap effect of the storage capacitor C, in a case where the voltage at the second terminal of the storage sub-circuit 140 (i.e., the second terminal of the storage capacitor C) jumps from the first reference level signal in the charging phase T2, i.e., 0V, to the second data voltage in the voltage jump phase T3, the voltage at the first terminal of the storage sub-circuit 140, that is, the gate voltage of the driving transistor DTFT jumps from the first voltage V1 in the charging phase T2 to a second voltage V2 in the voltage jump phase T3. The voltage threshold of a transistor is a fixed threshold (that is, the voltage difference between any two of the three electrodes of the transistor does not exceed the above fixed threshold, for example, 6V), so the control signals of the remaining transistors should jump accordingly to ensure the normal operation of each transistor. Specifically, the level of the first data scanning sub-signal provided to the control terminal of the first data writing sub-circuit through the first gate sub-line G1 is higher than the level of the first data scanning sub-signal in the charging phase T2, and the level of the second data scanning sub-signal provided to the control terminal of the first data writing sub-circuit through the second gate sub-line G2 is higher than the level of the second data scanning sub-signal in the charging phase T2, so that the transistor of the first data writing sub-circuit can be ensured to operate within a range allowed by the voltage threshold.

For example, as illustrated in FIG. 3A and FIG. 3B, in the reset phase T1, the level of the first data scanning sub-signal is a first data level, the level of the second data scanning sub-signal is a second data level, the level of the first reset control signal is a first reset level, and the level of the second reset control signal is the first reset level. In the charging phase T2, the level of the first data scanning sub-signal is a third data level, the level of the second data scanning sub-signal is a fourth data level, the level of the first reset control signal is a second reset level, and the level of the second reset control signal is the second reset level. In the voltage jump phase T3, the level of the first data scanning sub-signal is a fifth data level, the level of the second data scanning sub-signal is a sixth data level, the level of the first reset control signal is a third reset level, and the level of the second reset control signal is the third reset level. The first data level is lower than the third data level, the third data level is lower than the fifth data level, the second data level is higher than the fourth data level, the sixth data level is higher than the second data level, the first reset level is higher than the second reset level, and the first reset level is equal to the third reset level. That is, in the voltage jump phase T3, the level of the first data scanning sub-signal jumps from the first data level to the fifth data level, the level of the second data scanning sub-signal jumps from the second data level to the sixth data level, and the levels of the first reset control signal and the second reset control signal jump from the second reset level to the third reset level.

In the light emitting phase T4, the gate voltage of the driving transistor DTFT is the second voltage V2 mentioned above, therefore, by providing the light emitting control signal to the light emitting control sub-circuit 150 through the light emitting control signal line EM, the first level signal terminal Vdd, the first electrode of the driving transistor DTFT, the second electrode of the driving transistor DTFT, the light emitting diode OLED and the second level signal terminal Vss can form a path, so as to drive the light emitting element OLED to emit light.

For example, as illustrated in FIG. 3A and FIG. 3B, in some examples, both in the reset phase T1 and in the charging phase T2, the level of the light emitting control signal is a first light emitting control level; in the voltage jump phase T3, the level of the light emitting control signal is a second light emitting control level; and in the light emitting phase T4, the level of the light emitting control signal is a third light emitting control level. The first light emitting control level is lower than the second light emitting control level, and the first light emitting control level is equal to the third light emitting control level. That is, in the voltage jump phase T3, the level of the light emitting control signal jumps from the first light emitting control level to the second light emitting control level; and in the light emitting phase T4, the level of the light emitting control signal changes from the second light emitting control level to the third light emitting control level.

For example, as illustrated in FIG. 3A, in some examples, in the light emitting phase T4, the level of the first data scanning sub-signal is a seventh data level, the seventh data level is lower than the fifth data level, and the seventh data level can be equal to the third data level. That is, the level of the first data scanning sub-signal jumps from the fifth data level to the third data level; and the level of the second data scanning sub-signal maintains at the sixth data level, and the levels of the first reset control signal and the second reset control signal also maintain at the third reset level, that is, the level of the first reset control signal and the level of the second data scanning sub-signal do not jump.

For another example, as illustrated in FIG. 3B, in some other examples, in the light emitting phase T4, the level of the first data scanning sub-signal maintains at the fifth data level; and the level of the second data scanning sub-signal maintains at the sixth data level, and the levels of the first reset control signal and the second reset control signal also maintain at the third reset level, that is, the levels of the first reset control signal and the second reset control signal, the level of the first data scanning sub-signal, and the level of the second data scanning sub-signal do not jump.

For example, as illustrated in FIG. 3C, in a case where the driving transistor DTFT is a P-type transistor, the operation principle of the pixel circuit is similar to that in the case where the driving transistor DTFT is an N-type transistor, except that the levels of the respective control signals are different.

For example, in the reset phase T1, the level of the first data scanning sub-signal is a first data level, the level of the second data scanning sub-signal is a second data level, the level of the first reset control signal is a first reset level, the level of the second reset control signal is the first reset level, and the level of the light emitting control signal is a first light emitting control level; in the charging phase T2, the level of the first data scanning sub-signal is a third data level, the level of the second data scanning sub-signal is a fourth data level, the level of the first reset control signal is a second reset level, the level of the second reset control signal is the second reset level, and the level of the light emitting control signal is the first light emitting control level; in the voltage jump phase T3, the level of the first data scanning sub-signal is a fifth data level, the level of the second data scanning sub-signal is a sixth data level, the level of the first reset control signal is a third reset level, the level of the second reset control signal is the third reset level, and the level of the light emitting control signal is a second light emitting control level; and in the light emitting phase T4, the level of the first data scanning sub-signal is the fifth data level, the level of the second data scanning sub-signal is the sixth data level, the level of the first reset control signal is the third reset level, the level of the second reset control signal is the third reset level, and the level of the light emitting control signal is a third light emitting control level.

For example, the first data level is lower than the third data level, the fifth data level is lower than the first data level, the second data level is higher than the fourth data level, the fourth data level is higher than the sixth data level, the first reset level is higher than the second reset level, the second reset level is higher than the third reset level, the first light emitting control level is higher than the second light emitting control level, and the second light emitting control level is higher than the third light emitting control level. That is, in the voltage jump phase T3, the level of the first data scanning sub-signal jumps from the first data level to the fifth data level, the level of the second data scanning sub-signal jumps from the second data level to the sixth data level, the levels of the first reset control signal and the second reset control signal jump from the second reset level to the third reset level, and the level of the light emitting control signal jumps from the first light emitting control level to the second light emitting control level. In the light emitting phase T4, the third light emitting control level is lower than the second light emitting control level, so as to ensure that the light emitting control transistor P2 is turned on in the light emitting phase T4.

For example, in the reset phase T1, the charging phase T2 and the light emitting phase T4, the second data scanning signal is at a second level; and in the voltage jump phase T3, the second data scanning signal is at a first level. In the examples illustrated in FIGS. 3A-3C, the second level is a high level, and the first level is a low level.

According to the relationship between the gate voltage of the silicon-based driving transistor DTFT, the threshold voltage of the driving transistor DTFT, and the voltage difference $V_{EL}$ between the anode and cathode of the light emitting element OLED, the voltage difference $V_{EL}$ between the anode and cathode of the light emitting element OLED can be calculated.

For example, in a case where the gate voltage of the driving transistor DTFT is between 1V and 5V, the threshold voltage of the driving transistor DTFT is 1V, and the voltage provided by the second level signal terminal Vss is −3V, the voltage of the cathode of the light emitting element OLED is −3V, and a source voltage of the driving transistor DTFT is between 0V and 4V, that is, the voltage of the anode of the light emitting element OLED is between 0V and 4V. Therefore, the voltage difference $V_{EL}$ between the anode and the cathode of the light emitting element OLED is 3V~7V. It can be seen from FIG. 4B that the light emitting element OLED operates in Mode Two, which can realize low brightness and high contrast ratio.

It should be noted that in a case where the display device is required to display with high brightness, in the voltage jump phase T3, the second data scanning signal is provided to the control terminal of the second data writing sub-circuit 120, and the second data voltage is provided to the input terminal of the second data writing sub-circuit 120, and the second data voltage can be higher than the first data voltage. In this case, the gate voltage of the driving transistor DTFT can be between 5V and 9V, so that the source voltage of the driving transistor DTFT is between 4V and 8V, that is, the voltage of the anode of the light emitting element OLED is between 4V and 8V. Therefore, the voltage difference $V_{EL}$ between the anode and the cathode of the light emitting element OLED is 7V~11V, and the light emitting element OLED operates in Mode One, which can realize high brightness and high contrast ratio.

In the present disclosure, the specific structure of the first data writing sub-circuit 110 is not particularly limited. In an embodiment, the control terminal of the first data writing sub-circuit 110 includes an N-type control terminal (i.e., the first control sub-terminal) and a P-type control terminal (i.e., the second control sub-terminal). Accordingly, the first data scanning signal includes a first N-type data scanning signal and a first P-type data scanning signal. In the charging phase T2, the first N-type data scanning signal is provided to the N-type control terminal of the first data writing sub-circuit 110, and the first P-type data scanning signal is provided to the P-type control terminal of the first data writing sub-circuit 110.

For example, as illustrated in FIG. 2B, the first data writing sub-circuit 110 includes an N-type data writing transistor N1 and a P-type data writing transistor P1, a first electrode of the N-type data writing transistor N1 is electrically connected to a first electrode of the P-type data writing transistor P1 to form the input terminal of the first data writing sub-circuit 110, and a second electrode of the N-type data writing transistor N1 is electrically connected to a second electrode of the P-type data writing transistor P1 to form the output terminal of the first data writing sub-circuit 110. A gate electrode of the N-type data writing transistor N1 serves as the N-type control terminal, and a gate electrode of the P-type data writing transistor P1 serves as the P-type control terminal. It can be seen that the N-type data writing transistor N1 and the P-type data writing transistor P1 form a transmission gate.

The first electrode of the N-type data writing transistor N1 and the second electrode of the N-type data writing transistor N1 can be electrically connected in a case where the gate electrode of the N-type data writing transistor N1 receives the first N-type data scanning signal, and the first electrode of the N-type data writing transistor N1 and the second electrode of the N-type data writing transistor N1 can be disconnected in a case where the gate electrode of the N-type data writing transistor N1 receives a third N-type data scanning signal. The first data scanning sub-signal includes the first N-type data scanning signal and the third N-type data scanning signal, the first N-type data scanning signal is a high-level signal, and the third N-type data scanning signal is a low-level signal.

The first electrode of the P-type data writing transistor P1 and the second electrode of the P-type data writing transistor P1 can be electrically connected in a case where the gate electrode of the P-type data writing transistor P1 receives the first P-type data scanning signal, and the first electrode of the P-type data writing transistor P1 and the second electrode of the P-type data writing transistor P1 can be disconnected in a case where the gate electrode of the P-type data writing transistor P1 receives a third P-type data scanning signal. The second data scanning sub-signal includes the first P-type data scanning signal and the third P-type data scanning signal, the first P-type data scanning signal is a low-level signal, and the third P-type data scanning signal is a high-level signal.

The first data writing sub-circuit 110 is formed in the form of a transmission gate which includes the P-type data writing transistor and the N-type data writing transistor, thereby increasing the range of the data voltage allowed to be inputted by the first data writing sub-circuit 110. Specifically, the N-type data writing transistor N1 can allow a data voltage having a high voltage value to be inputted, and the P-type data writing transistor P1 can allow a data voltage having a low voltage value to be inputted.

In the present disclosure, the specific structure of the reset sub-circuit 130 is not particularly limited. In the specific embodiment illustrated in FIG. 2B, the reset sub-circuit 130 includes a first reset transistor N2 and a second reset transistor N3, and the first reset transistor N2 is an N-type transistor. A gate electrode of the first reset transistor N2 and a gate electrode of the second reset transistor N3 both receive the first reset control signal, that is, the first reset transistor N2 and the second reset transistor N3 are controlled by a same first reset control signal.

As illustrated in FIG. 2B, the gate electrode of the first reset transistor N2 serves as the control terminal of the reset sub-circuit 130, a first electrode of the first reset transistor N2 serves as the input terminal of the reset sub-circuit 130, and a second electrode of the first reset transistor N2 serves as the first output terminal of the reset sub-circuit 130. The first electrode of the first reset transistor N2 and the second electrode of the first reset transistor N2 can be electrically connected in a case where the gate electrode of the first reset transistor N2 receives a first reset control sub-signal, and the first electrode of the first reset transistor N2 and the second electrode of the first reset transistor N2 can be disconnected in a case where the gate electrode of the first reset transistor N2 receives a second reset control sub-signal. The first reset control signal includes the first reset control sub-signal and the second reset control sub-signal, and the first reset control sub-signal and the second reset control sub-signal are in opposite phases. The first electrode of the first reset transistor N2 is electrically connected to the first reference level signal terminal Vcom1, and therefore, the second terminal of the storage sub-circuit 130 can be reset by using the first reset transistor N2.

The gate electrode of the second reset transistor N3 is electrically connected to the gate electrode of the first reset transistor N2, a first electrode of the second reset transistor N3 is electrically connected to the first electrode of the first reset transistor N2, and a second electrode of the second reset transistor N3 serves as the second output terminal of the reset sub-circuit 130. The first electrode of the second reset transistor N3 and the second electrode of the second reset transistor N3 can be electrically connected in a case where the gate electrode of the second reset transistor N3 receives the first reset control sub-signal, and the first electrode of the second reset transistor N3 and the second electrode of the second reset transistor N3 can be disconnected in a case where the gate electrode of the second reset transistor N3 receives the second reset control sub-signal.

The first electrode of the second reset transistor N3 is electrically connected to the first reference level signal terminal Vcom1, and therefore, the anode of the light emitting element OLED can be reset by using the second reset transistor N3.

In the present disclosure, the type of the second reset transistor N3 is not particularly limited. For example, in the specific embodiment illustrated in FIG. 2B, the second reset transistor N3 is an N-type transistor.

In the present disclosure, the specific structure of the second data writing sub-circuit 120 is not particularly limited. For example, as illustrated in FIG. 2B, the second data writing sub-circuit 120 includes a first data writing transistor P3. A gate electrode of the first data writing transistor P3 serves as the control terminal of the second data writing sub-circuit 120, a first electrode of first data writing transistor P3 serves as the input terminal of the second data writing sub-circuit 120, and a second electrode of first data writing transistor P3 serves as the output terminal of the second data writing sub-circuit 120.

The first electrode of the first data writing transistor P3 and the second electrode of the first data writing transistor P3 can be electrically connected in a case where the gate electrode of the first data writing transistor P3 receives a third data scanning sub-signal, and the first electrode of the first data writing transistor P3 and the second electrode of the first data writing transistor P3 can be disconnected in a case where the gate electrode of the first data writing transistor P3 receives a fourth data scanning sub-signal. For example, the second data scanning signal includes the third data scanning sub-signal and the fourth data scanning sub-signal, and the third data scanning sub-signal and the fourth data scanning sub-signal are in opposite phases.

For example, the third data scanning sub-signal is a signal when the second data scanning signal is at the first level, and the fourth data scanning sub-signal is a signal when the second data scanning signal is at the second level.

For example, as illustrated in FIG. 2B, the first data writing transistor P3 is a P-type transistor. In this case, the third data scanning sub-signal is a low-level signal, and the fourth data scanning sub-signal is a high-level signal. Of course, the present disclosure is not limited to this case, and for example, the first data writing transistor P3 can also be set as an N-type transistor.

In the present disclosure, the specific structure of the light emitting control sub-circuit 150 is not particularly limited. In order to simplify the structure of the light emitting control sub-circuit 150, for example, the light emitting control sub-circuit 150 includes a light emitting control transistor P2.

For example, a gate electrode of the light emitting control transistor P2 serves as the control terminal of the light emitting control sub-circuit 150, a first electrode of the light emitting control transistor P2 is electrically connected to the first level signal terminal Vdd, and a second electrode of the light emitting control transistor P2 is electrically connected to the first electrode of the driving transistor DTFT.

The first electrode of the light emitting control transistor P2 and the second electrode of the light emitting control transistor P2 can be electrically connected in a case where the gate electrode of the light emitting control transistor P2 receives a first light emitting control sub-signal, and the first electrode of the light emitting control transistor P2 and the second electrode of the light emitting control transistor P2 can be disconnected in a case where the gate electrode of the light emitting control transistor P2 receives a second light emitting control sub-signal. For example, the light emitting control signal includes the first light emitting control sub-signal and the second light emitting control sub-signal, and the first light emitting control sub-signal and the second light emitting control sub-signal are in opposite phases.

In the present disclosure, there is no special requirement for the specific type of the light emitting control transistor P2. In the specific embodiment illustrated in FIG. 2B, the light emitting control transistor P2 is a P-type transistor, the first light emitting control sub-signal is a low-level signal, and the second light emitting control sub-signal is a high-level signal. In another embodiment, the light emitting control transistor can be an N-type transistor, and accordingly, the first light emitting control sub-signal is a high-level signal, and the second light emitting control sub-signal is a low-level signal.

In the present disclosure, there is no special requirement for the specific structure of the storage sub-circuit 140, as long as the first data voltage written by the first data writing sub-circuit 110 and the second data voltage written by the second data writing sub-circuit 120 can be stored, and the voltage at the first terminal of the storage sub-circuit 140 can be controlled when the second data voltage is written by the second data writing sub-circuit 120. In the specific embodiment illustrated in FIG. 2B, the storage sub-circuit 140 includes a storage capacitor C, a first terminal of the storage capacitor C serves as the first terminal of the storage sub-circuit 140, and a second terminal of the storage capacitor C serves as the second terminal of the storage sub-circuit 140.

In the specific embodiment illustrated in FIG. 2B, the first data writing sub-circuit 110 includes the N-type data writing transistor N1 and the P-type data writing transistor P1, the second data writing sub-circuit 120 includes the first data writing transistor P3, the reset sub-circuit 130 includes the first reset transistor N2 and the second reset transistor N3, the storage sub-circuit 140 includes the storage capacitor C, and the light emitting control sub-circuit 150 includes the light emitting control transistor P2. For example, in the example illustrated in FIG. 2B, the N-type data writing transistor N1, the first reset transistor N2, and the second reset transistor N3 are all N-type transistors, and the P-type data writing transistor P1, the light emitting control transistor P2, and the first data writing transistor P3 are all P-type transistors.

The gate electrode of the N-type data writing transistor N1 is electrically connected to a first N-type gate line G1, the gate electrode of the P-type data writing transistor P1 is electrically connected to a first P-type gate line G2, the gate electrode of the first reset transistor N2 is electrically connected to the first reset control signal line RS1, the gate electrode of the second reset transistor N3 is electrically connected to the first reset control signal line RS1, the gate electrode of the first data writing transistor P3 is electrically connected to the second gate line G3, and the gate electrode of the light emitting control transistor P2 is electrically connected to the light emitting control signal line EM. The input terminal of the first data writing sub-circuit 110 is electrically connected to the first data line D1, and the input terminal of the second data writing sub-circuit 120 is electrically connected to the second data line D2.

As illustrated in FIG. 3A, in the reset phase T1, the first N-type gate line G1 provides a third N-type data scanning signal of low level, the first P-type gate line G2 provides a third P-type data scanning signal of high level, the first reset control signal line RS1 provides a first reset control sub-signal of high level, the light emitting control signal line EM provides a first light emitting control sub-signal of high level, and neither the first data line D1 nor the second data line D2 has a signal input. In the reset phase T1, no signal is provided to the second gate line G3 or a high-level signal is provided to the second gate line G3. Accordingly, in the reset phase T1, the N-type data writing transistor N1 and the P-type data writing transistor P1 both are turned off, the first data writing transistor P3 and the light emitting control transistor P2 are also turned off, and the first reset transistor N2 and the second reset transistor N3 are turned on, thereby resetting the second terminal of the storage capacitor C and the anode of the light emitting element OLED. Resetting the second terminal of the storage capacitor C and the anode of the light emitting element OLED can prevent the display device including the pixel circuit from generating motion blur during display.

In the charging phase T2, a first N-type data scanning signal of high level is provided to the first N-type gate line G1, a first P-type data scanning signal of low level is provided to the first P-type gate line G2, a second reset control sub-signal of low level is provided to the first reset control signal line RS1, a first light emitting control sub-signal of high level is provided to the light emitting control signal line EM, a first data voltage is provided to the first data line D1, and no data voltage is provided to the second data line D2. In the charging phase T2, a high-level signal is provided to the second gate line G3. In the charging phase T2, both the N-type data writing transistor N1 and the P-type data writing transistor P1 are turned on, and the first data voltage is written into the first terminal of the storage capacitor C. In addition, the first data writing transistor P3, the light emitting control transistor P2, the first reset transistor N2, and the second reset transistor N3 are all turned off, and at this time, the gate voltage of the driving transistor DTFT is a first voltage V1, that is, the first data voltage.

In the voltage jump phase T3, a fourth data scanning sub-signal of low level is provided to the second gate line G3 to control the first data writing transistor P3 to be turned on, so that the second data voltage can be written into the second terminal of the storage capacitor C through the second data line D2. In this case, due to the bootstrap effect of the storage capacitor C, the voltage at the first terminal of the storage capacitor C, that is, the gate voltage of the driving transistor DTFT, rises to a second voltage V2, and the second voltage V2 is a sum of the first data voltage and the second data voltage. Because all the transistors are silicon-based transistors, in order to ensure that the voltage difference between any two electrodes of the N-type data writing transistor N1 is within a threshold voltage range and the voltage difference between any two electrodes of the P-type data writing transistor P1 is within a threshold voltage range, accordingly, the voltage of the signal written by the first N-type gate line G1 and the voltage of the signal written by the first P-type gate line G2 should be higher than the respective voltages in the charging phase T2, as illustrated in FIG. 3A.

In the light emitting phase T4, a low-level signal is provided to the first N-type gate line G1, and a high-level signal is provided to the first P-type gate line G2, so as to ensure that both the N-type data writing transistor N1 and the P-type data writing transistor P2 are in an off state. Furthermore, a high-level signal is provided to the second gate line G3, so as to ensure that the first data writing transistor P3 is turned off. In the light emitting phase T4, the gate voltage of the driving transistor DTFT maintains as the second voltage V2. According to the source following principle, the source voltage of the driving transistor DTFT (i.e., the voltage of the second electrode of the driving transistor DTFT) is V2−Vth, where Vth is the threshold voltage of the driving transistor DTFT. In the present disclosure, because the second voltage V2 has a high voltage range, the source voltage of the driving transistor DTFT (i.e., the voltage of the anode of the light emitting element OLED) also has a high voltage range, thereby satisfying the requirements for realizing Mode One, which is a display mode of high contrast ratio and high brightness.

What has been described above is the operation principle of the pixel circuit to realize Mode One, which is a display mode of high contrast ratio and high brightness, and the operation principle of the pixel circuit to realize Mode Two, which is a display mode of high contrast ratio and low brightness, is briefly described below.

In a case where Mode Two of the pixel circuit is realized, an operation period of the pixel circuit can include only the reset phase T1, the charging phase T2, and the light emitting phase T4, without including the voltage jump phase T3. Of course, the present disclosure is not limited thereto. The operation period of the pixel circuit can also include the voltage jump phase T3, and a difference lies in that a voltage of 0V is provided by the second data line D2 in the voltage jump phase T3. Therefore, in the voltage jump phase T3, the voltage of the first N-type gate line G1 maintains as the voltage thereof in the charging phase T2, the voltage of the first P-type gate line G2 maintains as the voltage thereof in the charging phase T2, the gate voltage of the driving transistor DTFT is still the first data voltage V1, and the source voltage of the driving transistor DTFT is V1−Vth. Because the first voltage V1 is lower than the second voltage V2, the source voltage of the driving transistor DTFT is also lower than V2−Vth, thereby ensuring that the voltage difference between the anode and the cathode of the light emitting element OLED is relatively small and satisfying the requirement of Mode Two of low brightness.

Figure 5:
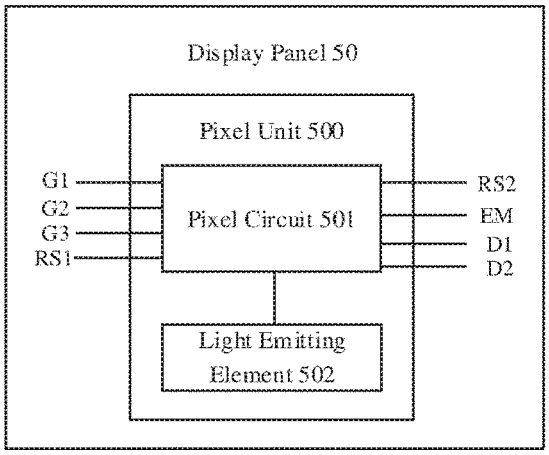
FIG. 5 is a schematic diagram of a display panel provided by some embodiments of the present disclosure.

At least some embodiments of the present disclosure further provide a display panel, and FIG. 5 is a schematic diagram of a display panel provided by some embodiments of the present disclosure.

For example, as illustrated in FIG. 5, a display panel 50 includes a plurality of pixel units 500. Each of the pixel units 500 is provided with a pixel circuit 501 therein. For example, the pixel circuit 501 is the pixel circuit 10 provided by any one of the above embodiments of the present disclosure. And each of the pixel units 500 further includes a light emitting element 502, the light emitting element 502 is the light emitting element OLED described by any one of the above embodiments, and the pixel circuit 501 is configured to drive the light emitting element 502 to emit light.

For example, the plurality of pixel units 500 are arranged in a plurality of rows and a plurality of columns, the plurality of rows of pixel units in the plurality of pixel units 500 are in one-to-one correspondence with a plurality of gate line groups, respectively, and the plurality of columns of pixel units 500 in the plurality of pixel units 500 are in one-to-one correspondence with a plurality of data line groups, respectively.

As illustrated in FIG. 1B, FIG. 2A and FIG. 5, each gate line group of the plurality of gate line groups includes a first gate line and a second gate line G3, the first gate line is configured to provide a first data scanning signal, and the second gate line G3 is configured to provide a second data scanning signal. Each gate line group further includes a first reset control signal line RS1, a second reset control signal line RS2, and a light emitting control signal line EM. In a same row of pixel units, the control terminal of the first data writing sub-circuit 110 in each of the pixel units 500 is electrically connected to the first gate line to receive the first data scanning signal, the control terminal of the second data writing sub-circuit 120 in each of the pixel units 500 is electrically connected to the second gate line G3 to receive the second data scanning signal, the control terminal of the reset sub-circuit in each of the pixel units 500 is electrically connected to the first reset control signal line RS1 and the second reset control signal line RS2, and the control terminal of the light emitting control sub-circuit 150 in each of the pixel units 500 is electrically connected to the light emitting control signal line EM.

Each data line group of the plurality of data line groups includes a first data line D1 and a second data line D2, the first data line D1 is configured to provide a first data voltage, and the second data line D2 is configured to provide a second data voltage. In a same column of pixel units, the input terminal of the first data writing sub-circuit 110 in each of the pixel units 500 is electrically connected to the first data line D1 to receive the first data voltage, and the input terminal of the second data writing sub-circuit 120 in each of the pixel units 500 is electrically connected to the second data line D2 to receive the second data voltage.

For example, the control terminal of the first data writing sub-circuit 110 includes an N-type control terminal (i.e., a first control sub-terminal) and a P-type control terminal (i.e., a second control sub-terminal), and the first data scanning signal includes a first N-type data scanning signal and a first P-type data scanning signal.

Moreover, the first data writing sub-circuit 110 includes an N-type data writing transistor N1 and a P-type data writing transistor N2. Accordingly, the first gate line includes a first gate sub-line G1 (i.e., a first N-type gate line G1) and a second gate sub-line G2 (i.e., a first P-type gate line G2). In a same row of pixel units, the N-type control terminal in each of the pixel units is electrically connected to the first N-type gate line G1, and the P-type control terminal in each of the pixel units is electrically connected to the first P-type gate line G2.

Figure 6:
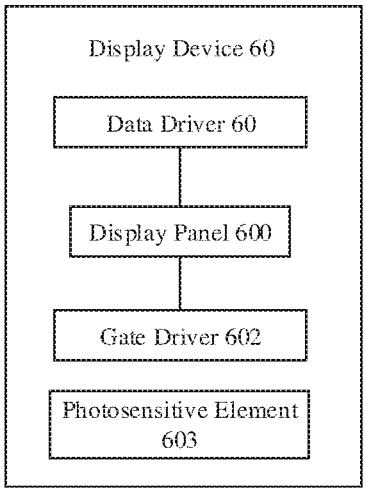
FIG. 6 is a schematic diagram of a display device provided by some embodiments of the present disclosure.

At least some embodiments of the present disclosure further provide a display device, and FIG. 6 is a schematic diagram of a display device provided by some embodiments of the present disclosure.

For example, as illustrated in FIG. 6, a display device 60 includes a display panel 600 and a photosensitive element 603. For example, the display panel 600 is the above-mentioned display panel 50 provided by the present disclosure, and the photosensitive element 603 is configured to detect brightness of an environment in which the display device 60 is located, generate a first trigger signal to control the display device 60 to be in a first operation mode in a case where the brightness of the environment is higher than or equal to a preset brightness, and generate a second trigger signal to control the display device 60 to be in a second operation mode in a case where the brightness of the environment is lower than the preset brightness.

For example, the display brightness of the display device 60 in the first operation mode is higher than the display brightness of the display device 60 in the second operation mode. The first operation mode is Mode One described above in FIG. 4A and FIG. 4B, and the second operation mode is Mode Two described above in FIG. 4A and FIG. 4B.

For example, as illustrated in FIG. 6, the display device 60 further includes a data driver 601. The data driver 601 is electrically connected to the pixel circuit in the display panel 600 via the first data line D1 and the second data line D2, provide a first data voltage to the pixel circuit in the display panel 600 via the first data line D1, and provide a second data voltage to the pixel circuit in the display panel 600 via the second data line D2.

It should be noted that in a case where the display device 60 is in the first operation mode, in the charging phase, the data driver 601 provides the first data voltage to the pixel circuit in the display panel 600 via the first data line D1; and in the voltage jump phase, the data driver 601 provides the second data voltage to the pixel circuit in the display panel 600 via the second data line D2. In a case where the display device 60 is in the second operation mode, the data driver 601 may only provide the first data voltage to the pixel circuit in the display panel 600 via the first data line D1 in the charging phase.

For example, as illustrated in FIG. 6, the display device 60 further includes a gate driver 602. The gate driver 602 is configured to provide a first data scanning signal and a second data scanning signal to the pixel circuit in the display panel 600. For example, in a case where the display device 60 is in the first operation mode, in the voltage jump phase, the level of the first data scanning signal and the level of the second data scanning signal both jump. FIGS. 3A-3C illustrate several schematic waveforms of the first data scanning signal and the second data scanning signal.

Figure 7:
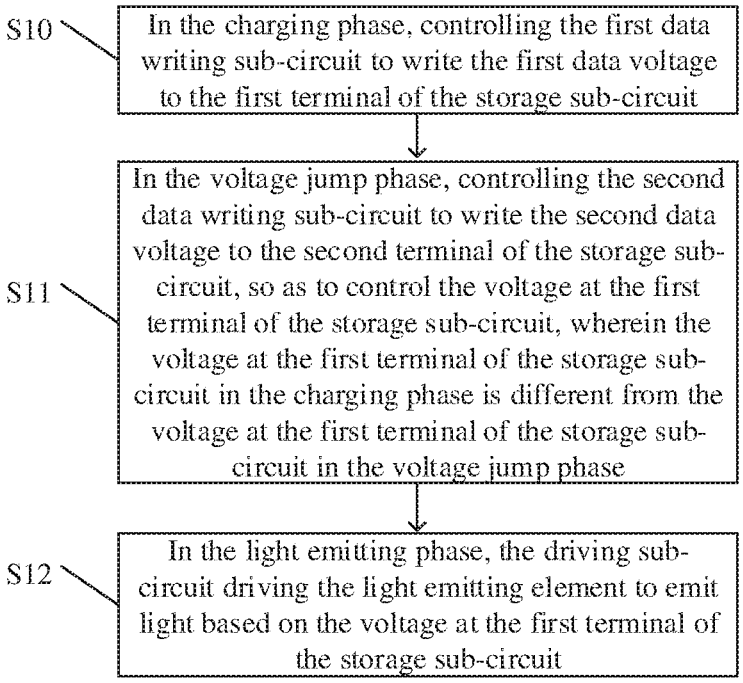
FIG. 7 is a schematic flowchart of a method of driving a display device provided by some embodiments of the present disclosure.

At least some embodiments of the present disclosure further provide a method of driving a display device, and the method can drive any display device provided by the present disclosure. FIG. 7 is a schematic flowchart of a method of driving a display device provided by some embodiments of the disclosure.

For example, in some embodiments, in a case where the photosensitive element generates the first trigger signal, as illustrated in FIGS. 3A-3B, an operation period of the display panel includes a reset phase T1, a charging phase T2, a voltage jump phase T3 and a light emitting phase T4. And as illustrated in FIG. 7, the method includes:

S10: in the charging phase, controlling the first data writing sub-circuit to write the first data voltage to the first terminal of the storage sub-circuit;

S11: in the voltage jump phase, controlling the second data writing sub-circuit to write the second data voltage to the second terminal of the storage sub-circuit, so as to control the voltage at the first terminal of the storage sub-circuit, in which the voltage at the first terminal of the storage sub-circuit in the charging phase is different from the voltage at the first terminal of the storage sub-circuit in the voltage jump phase; and S12: in the light emitting phase, the driving sub-circuit driving the light emitting element to emit light based on the voltage at the first terminal of the storage sub-circuit.

For example, in step S11, in a case where the driving transistor is an N-type transistor, the voltage at the first terminal of the storage sub-circuit in the charging phase is lower than the voltage at the first terminal of the storage sub-circuit in the voltage jump phase; and in a case where the driving transistor is a P-type transistor, the voltage at the first terminal of the storage sub-circuit in the charging phase is higher than the voltage at the first terminal of the storage sub-circuit in the voltage jump phase.

For example, the method further includes: in the reset phase, writing a first reference level signal to the second terminal of the storage sub-circuit through the reset sub-circuit, so as to reset the second terminal of the storage sub-circuit, and writing the first reference level signal to the anode of the light emitting element through the reset sub-circuit, so as to reset the anode of the light emitting element.

For example, in some embodiments, the display device can further include a driving circuit, which is configured to perform various steps in the method described above. For example, the driving circuit is configured for following operations (e.g., providing signals).

In the reset phase T1, first reset control sub-signals are provided to all first reset control signal lines and all second reset control signal lines, third N-type data scanning signals and third P-type data scanning signals are provided to all first gate lines, fourth data scanning sub-signals are provided to all second gate lines, and second light emitting control sub-signals are provided to all light emitting control signal lines.

In the charging phase T2, second reset control sub-signals are provided to all first reset control signal lines and all second reset control signal lines, a first N-type data scanning signal and a first P-type data scanning signal are provided to each first gate line sequentially according to a predetermined scanning sequence, fourth data scanning sub-signals are provided to all second gate lines, second light emitting control sub-signals are provided to all light emitting control signal lines, and first data voltages are provided to all first data lines.

In the voltage jump phase T3, second reset control sub-signals are provided to all first reset control signal lines and all second reset control signal lines, fifth N-type data scanning signals and fifth P-type data scanning signals are provided to all first gate lines, a third data scanning sub-signal is provided to each second gate line sequentially according to the predetermined scanning sequence, second light emitting control sub-signals are provided to all light emitting control signal lines, and second data voltages are provided to all second data lines. The second data voltage is higher than the first data voltage by a preset value. For example, the first data scanning sub-signal can further include a fifth N-type data scanning signal, and the second data scanning sub-signal can further include a fifth P-type data scanning signal. As illustrated in FIG. 3A and FIG. 3B, the voltage of the fifth N-type data scanning signal is higher than the voltage of the first N-type data scanning signal and also higher than the voltage of the third N-type data scanning signal, and the voltage of the fifth P-type data scanning signal is higher than the voltage of the first P-type data scanning signal and also higher than the voltage of the third P-type data scanning signal.

In the light emitting phase T4, second reset control sub-signals are provided to all first reset control signal lines and all second reset control signal lines, third N-type data scanning signals and third P-type data scanning signals are provided to all first gate lines, fourth data scanning sub-signals are provided to all second gate lines, and first light emitting control sub-signals are provided to all light emitting control signal lines.

It should be noted that in the light emitting phase T4, the driving circuit may also provide the fifth N-type data scanning signals and the fifth P-type data scanning signals to all the first gate lines.

The operation principle and beneficial effects of the pixel circuit have been described in detail above and are not described here again.

In the present disclosure, the "preset value" is not particularly limited. For example, for a light emitting diode, the data voltage range for realizing high contrast ratio (e.g., 20000:1) and high brightness (>1500 nit) is 5V to 9V, while the data voltage range for realizing high contrast ratio (e.g., 20000:1) and low brightness (375 nit) is 1V to 5V. Thus, in the present disclosure, the preset value is 3V.

It should be noted that in some other embodiments, in a case where the photosensitive element generates the second trigger signal, an operation period of the display panel includes three phases: a reset phase, a charging phase and a light emitting phase.

For example, the method includes: in the charging phase, controlling the first data writing sub-circuit to write a first data voltage to the first terminal of the storage sub-circuit; and in the light emitting phase, the driving sub-circuit driving the light emitting element to emit light based on the voltage at the first terminal of the storage sub-circuit.

Alternatively, in a case where the photosensitive element generates the second trigger signal, an operation period of the display panel also includes a reset phase, a charging phase, a voltage jump phase and a light emitting phase, and a difference lies in that the signals in the charging phase are identical to the signals in the voltage jump phase and the second data voltage is 0V in the voltage jump phase.

For example, in an embodiment where the control terminal of the first data writing sub-circuit includes an N-type control terminal and a P-type control terminal, and the first data writing sub-circuit includes an N-type data writing transistor and a P-type data writing transistor:

the first data scanning signal includes a first N-type data scanning signal provided to the first N-type gate line, a first P-type data scanning signal provided to the first P-type gate line, a third N-type data scanning signal provided to the first N-type gate line, and a third P-type data scanning signal provided to the first P-type gate line, the first N-type data scanning signal is a high-level signal, the third N-type data scanning signal is a low-level signal, the first P-type data scanning signal is a low-level signal, and the third P-type data scanning signal is a high-level signal; and the first data scanning signal can further include a fifth N-type data scanning signal provided to the first N-type gate line and a fifth P-type data scanning signal provided to the first P-type gate line, the voltage of the fifth N-type data scanning signal is higher than the voltage of the first N-type data scanning signal, and the voltage of the fifth P-type data scanning signal is higher than the voltage of the first P-type data scanning signal. For example, in some examples, the voltage of the fifth N-type data scanning signal is also higher than the voltage of the third N-type data scanning signal, and the voltage of the fifth P-type data scanning signal is also higher than the voltage of the third P-type data scanning signal.

In the present disclosure, the specific structure of the display device 60 is not particularly limited. For example, the display device 60 can be a near-eye device (e.g., VR glasses), so that a virtual scene can be better simulated according to the surrounding environment, which is beneficial to improving the user's experience.

It should be understood that the above embodiments are merely exemplary embodiments adopted to illustrate the principles of the present disclosure, but the present disclosure is not limited thereto. It is apparent to those skilled in the art that various modifications and improvements can be made without departing from the spirit and essence of the present disclosure, and these modifications and improvements are also within the scope of protection of the present disclosure.

What is claimed is:

1. A pixel circuit, comprising: a driving sub-circuit, a first data writing sub-circuit, a second data writing sub-circuit, and a storage sub-circuit, wherein the first data writing sub-circuit is electrically connected to a first terminal of the storage sub-circuit, and is configured to write a first data voltage to the first terminal of the storage sub-circuit in a case of being turned on under control of a first data scanning signal;

the second data writing sub-circuit is electrically connected to a second terminal of the storage sub-circuit, and is configured to write a second data voltage to the second terminal of the storage sub-circuit in a case of being turned on under control of a second data scanning signal, so as to control a voltage at the first terminal of the storage sub-circuit based on the second data voltage;

the first terminal of the storage sub-circuit is further electrically connected to a control terminal of the driving sub-circuit; and the driving sub-circuit is configured to drive a light emitting element to emit light under control of the voltage at the first terminal of the storage sub-circuit;

the pixel circuit further comprises a reset sub-circuit, wherein a first output terminal of the reset sub-circuit is electrically connected to the second terminal of the storage sub-circuit, a second output terminal of the reset sub-circuit is electrically connected to an anode of the light emitting element, and the reset sub-circuit is configured to reset the second terminal of the storage sub-circuit under control of a first reset control signal, and to reset the anode of the light emitting element under control of a second reset control signal.

2. The pixel circuit according to claim 1, wherein the second data writing sub-circuit comprises a first data writing transistor, a gate electrode of the first data writing transistor is configured to receive the second data scanning signal, a first electrode of the first data writing transistor is configured to receive the second data voltage, and a second electrode of the first data writing transistor is electrically connected to the second terminal of the storage sub-circuit.

3. The pixel circuit according to claim 2, wherein the first data writing transistor is turned on in a case where the second data scanning signal is at a first level, the first data writing transistor is turned off in a case where the second data scanning signal is at a second level, and the first level is opposite to the second level.

4. The pixel circuit according to claim 2, wherein the first data writing transistor is a P-type transistor.

5. The pixel circuit according to claim 1, wherein a control terminal of the first data writing sub-circuit is configured to receive the first data scanning signal, the control terminal of the first data writing sub-circuit comprises a first control sub-terminal and a second control sub-terminal, the first data scanning signal comprises a first data scanning sub-signal and a second data scanning sub-signal, the first control sub-terminal is configured to receive the first data scanning sub-signal, and the second control sub-terminal is configured to receive the second data scanning sub-signal.

6. The pixel circuit according to claim 5, wherein the first data writing sub-circuit comprises an N-type data writing transistor and a P-type data writing transistor, a first electrode of the N-type data writing transistor and a first electrode of the P-type data writing transistor are both configured to receive the first data voltage, a second electrode of the N-type data writing transistor and a second electrode of the P-type data writing transistor are both electrically connected to the first terminal of the storage sub-circuit, the first control sub-terminal comprises a gate electrode of the N-type data writing transistor, and the second control sub-terminal comprises a gate electrode of the P-type data writing transistor.

7. The pixel circuit according to claim 1, wherein an input terminal of the reset sub-circuit is electrically connected to a first reference level signal terminal and a second reference level signal terminal, the reset sub-circuit is configured to write a first reference level signal of the first reference level signal terminal to the second terminal of the storage sub-circuit under control of the first reset control signal, so as to reset the second terminal of the storage sub-circuit, and the reset sub-circuit is further configured to write a second reference level signal of the second reference level signal terminal to the anode of the light emitting element under control of the second reset control signal, so as to reset the anode of the light emitting element.

8. The pixel circuit according to claim 7, wherein the reset sub-circuit comprises a first reset transistor and a second reset transistor, the input terminal of the reset sub-circuit comprises a first electrode of the first reset transistor and a first electrode of the second reset transistor, the first output terminal comprises a second electrode of the first reset transistor, the second output terminal comprises a second electrode of the second reset transistor, a gate electrode of the first reset transistor is configured to receive the first reset control signal, the first electrode of the first reset transistor is electrically connected to the first reference level signal terminal, the second electrode of the first reset transistor is electrically connected to the second terminal of the storage sub-circuit, a gate electrode of the second reset transistor is configured to receive the second reset control signal, the first electrode of the second reset transistor is electrically connected to the second reference level signal terminal, and the second electrode of the second reset transistor is electrically connected to the anode of the light emitting element.

9. The pixel circuit according to claim 1, further comprising a light emitting control sub-circuit, wherein the light emitting control sub-circuit is configured to electrically connect or disconnect the driving sub-circuit and the light emitting element under control of a light emitting control signal.

10. The pixel circuit according to claim 9, wherein the light emitting control sub-circuit comprises a light emitting control transistor, a gate electrode of the light emitting control transistor is configured to receive the light emitting control signal, a first electrode of the light emitting control transistor is electrically connected to a first level signal terminal, and a second electrode of the light emitting control transistor is electrically connected to the driving sub-circuit.

11. The pixel circuit according to claim 9, wherein the driving sub-circuit comprises a driving transistor, a first electrode of the driving transistor is electrically connected to the light emitting control sub-circuit, a second electrode of the driving transistor is electrically connected to an anode of the light emitting element, and the control terminal of the driving sub-circuit comprises a gate electrode of the driving transistor, the gate electrode of the driving transistor is electrically connected to the first terminal of the storage sub-circuit, and a cathode of the light emitting element is electrically connected to a second level signal terminal.

12. The pixel circuit according to claim 1, wherein the storage sub-circuit comprises a storage capacitor, the first terminal of the storage sub-circuit comprises a first terminal of the storage capacitor, and the second terminal of the storage sub-circuit comprises a second terminal of the storage capacitor.

13. A display panel, comprising the pixel circuit according to claim 1.

14. The display panel according to claim 13, further comprising a plurality of pixel units, wherein the plurality of pixel units are arranged in a plurality of rows and a plurality of columns, and the pixel circuit is disposed in at least one of the plurality of pixel units.

15. The display panel according to claim 14, wherein the plurality of rows of pixel units in the plurality of pixel units are in one-to-one correspondence with a plurality of gate line groups, respectively, and the plurality of columns of pixel units in the plurality of pixel units are in one-to-one correspondence with a plurality of data line groups, respectively;

each of the plurality of gate line groups comprises a first gate line and a second gate line, the first gate line is configured to provide the first data scanning signal, and the second gate line is configured to provide the second data scanning signal;

in pixel units of a same row, the first data writing sub-circuit in each of the pixel units is electrically connected to the first gate line to receive the first data scanning signal, and the second data writing sub-circuit in each of the pixel units is electrically connected to the second gate line to receive the second data scanning signal;

each of the plurality of data line groups comprises a first data line and a second data line, the first data line is configured to provide the first data voltage, and the second data line is configured to provide the second data voltage; and in pixel units of a same column, the first data writing sub-circuit in each of the pixel units is electrically connected to the first data line to receive the first data voltage, and the second data writing sub-circuit in each of the pixel units is electrically connected to the second data line to receive the second data voltage.

16. The display panel according to claim 15, wherein, in a case where a control terminal of the first data writing sub-circuit comprises a first control sub-terminal and a second control sub-terminal, the first gate line comprises a first gate sub-line and a second gate sub-line, and in the pixel units of the same row, the first control sub-terminal of the first data writing sub-circuit in each of the pixel units is electrically connected to the first gate sub-line, and the second control sub-terminal of the first data writing sub-circuit in each of the pixel units is electrically connected to the second gate sub-line.

17. A display device, comprising the display panel according to claim 13.

18. The display device according to claim 17, further comprising a photosensitive element, wherein the photosensitive element is configured to detect brightness of an environment in which the display device is located, generate a first trigger signal to control the display device to be in a first operation mode in a case where the brightness is higher than or equal to a preset brightness, and generate a second trigger signal to control the display device to be in a second operation mode in a case where the brightness is lower than the preset brightness.

19. A method of driving the display device according to claim 18, wherein, in a case where the photosensitive element generates the first trigger signal, an operation period of the display panel comprises a charging phase, a voltage jump phase, and a light emitting phase, and the method comprises:

in the charging phase, controlling the first data writing sub-circuit to write the first data voltage to the first terminal of the storage sub-circuit;

in the voltage jump phase, controlling the second data writing sub-circuit to write the second data voltage to the second terminal of the storage sub-circuit, so as to control the voltage at the first terminal of the storage sub-circuit, wherein the voltage at the first terminal of the storage sub-circuit during the charging phase is different from the voltage at the first terminal of the storage sub-circuit during the voltage jump phase; and in the light emitting phase, the driving sub-circuit driving the light emitting element to emit light based on the voltage at the first terminal of the storage sub-circuit.

* * * * *